US008988292B2

(12) United States Patent
Hotta et al.

(10) Patent No.: US 8,988,292 B2
(45) Date of Patent: Mar. 24, 2015

(54) ANTENNA DEVICE AND ELECTRONIC DEVICE INCLUDING ANTENNA DEVICE

(75) Inventors: Hiroyuki Hotta, Hamura (JP); Koichi Sato, Tachikawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 441 days.

(21) Appl. No.: 13/345,283

(22) Filed: Jan. 6, 2012

(65) Prior Publication Data

US 2012/0249393 A1 Oct. 4, 2012

(30) Foreign Application Priority Data

Mar. 30, 2011 (JP) ..... 2011-076288

(51) Int. Cl.

| | |
|---|---|
| ***H01Q 1/24*** | (2006.01) |
| ***H01Q 1/38*** | (2006.01) |
| ***H01Q 5/00*** | (2006.01) |
| ***H01Q 7/00*** | (2006.01) |
| ***H01Q 9/42*** | (2006.01) |

(52) U.S. Cl.

CPC ..... *H01Q 1/243* (2013.01); *H01Q 1/38* (2013.01); *H01Q 5/0055* (2013.01); *H01Q 5/0062* (2013.01); *H01Q 7/00* (2013.01); *H01Q 9/42* (2013.01)

USPC ..... 343/702; 343/700 MS

(58) Field of Classification Search

CPC ..... H01Q 1/243; H01Q 1/38; H01Q 5/0055; H01Q 7/00; H01Q 9/42

USPC ..... 343/700 MS, 702, 829, 843, 846

See application file for complete search history.

(56) References Cited

U.S. PATENT DOCUMENTS

| | | | | |
|---|---|---|---|---|
| 6,407,710 | B2 * | 6/2002 | Keilen et al. | 343/702 |
| 6,639,560 | B1 * | 10/2003 | Sullivan et al. | 343/700 MS |
| 6,738,603 | B1 | 5/2004 | Saito | |
| 6,870,504 | B2 | 3/2005 | Ikegaya et al. | |

(Continued)

FOREIGN PATENT DOCUMENTS

| | | |
|---|---|---|
| JP | 09-307344 | 11/1997 |
| JP | 1079622 | 3/1998 |

(Continued)

OTHER PUBLICATIONS

Japanese Patent Application No. 2011-076288, First Office Action, mailed Apr. 17, 2012, (with English Translation).

(Continued)

*Primary Examiner* — Tho G Phan

(74) *Attorney, Agent, or Firm* — Blakely, Sokoloff, Taylor & Zafman LLP

(57) ABSTRACT

According to one embodiment, a first antenna element is formed from a folded monopole element having one end connected to a feeding terminal, and the other end connected to a first ground terminal, with a stub being provided between a forward portion and a backward portion formed by folding a middle portion. A second antenna element is formed from a monopole element having one end connected to the feeding terminal directly or indirectly through part of the first antenna element. A third antenna element is formed from a parasitic element having one end connected to a second ground terminal provided at a position opposite to the first ground terminal through the feeding terminal, and the other end open, with at least part of the parasitic element being placed parallel to the second antenna element so as to be configured to be capacitively coupled to the second antenna element.

22 Claims, 24 Drawing Sheets

When distal end portion is formed into meandering shape

(56) References Cited

U.S. PATENT DOCUMENTS

| | | | | |
|---|---|---|---|---|
| 6,930,641 | B2 * | 8/2005 | Ohara et al. | 343/702 |
| 7,026,999 | B2 | 4/2006 | Umehara et al. | |
| 7,136,022 | B2 | 11/2006 | Sato et al. | |
| 7,319,432 | B2 * | 1/2008 | Andersson | 343/702 |
| 7,345,637 | B2 | 3/2008 | Mizoguchi et al. | |
| 7,403,160 | B2 | 7/2008 | Chiang et al. | |
| 7,791,546 | B2 | 9/2010 | Hotta et al. | |
| 7,825,859 | B2 | 11/2010 | Teshima | |
| 7,825,861 | B2 | 11/2010 | Sato et al. | |
| 7,885,614 | B2 | 2/2011 | Jedeloo | |
| 7,965,242 | B2 | 6/2011 | Abramov et al. | |
| 8,063,827 | B2 * | 11/2011 | Hotta et al. | 343/700 MS |
| 8,098,211 | B2 * | 1/2012 | Onaka et al. | 343/866 |
| 8,717,241 | B2 * | 5/2014 | Shamblin et al. | 343/702 |
| 2003/0184484 | A1 | 10/2003 | Ikegaya et al. | |
| 2003/0193437 | A1 | 10/2003 | Kangasvieri et al. | |
| 2004/0108957 | A1 | 6/2004 | Umehara et al. | |
| 2005/0094530 | A1 | 5/2005 | Nakagawa et al. | |
| 2005/0153756 | A1 | 7/2005 | Sato et al. | |
| 2007/0164920 | A1 | 7/2007 | Chen | |
| 2007/0229366 | A1 | 10/2007 | Kim et al. | |
| 2008/0169981 | A1 | 7/2008 | Hotta et al. | |
| 2008/0258992 | A1 | 10/2008 | Tsai et al. | |
| 2009/0027286 | A1 | 1/2009 | Ohishi et al. | |
| 2009/0079639 | A1 | 3/2009 | Hotta et al. | |
| 2009/0115388 | A1 | 5/2009 | Miyazaki et al. | |
| 2009/0174611 | A1 | 7/2009 | Schlub et al. | |
| 2009/0231213 | A1 | 9/2009 | Ishimiya | |
| 2010/0026596 | A1 | 2/2010 | Nishio et al. | |
| 2010/0156745 | A1 | 6/2010 | Andrenko et al. | |
| 2010/0194658 | A1 | 8/2010 | Yukimoto et al. | |
| 2010/0214181 | A1 | 8/2010 | Ryou et al. | |
| 2010/0321272 | A1 | 12/2010 | Yukimoto et al. | |
| 2011/0074638 | A1 | 3/2011 | Gong et al. | |
| 2011/0183633 | A1 | 7/2011 | Ohba et al. | |
| 2013/0050036 | A1 | 2/2013 | Kashiwagi et al. | |
| 2013/0050057 | A1 | 2/2013 | Hayashi et al. | |

FOREIGN PATENT DOCUMENTS

| | | |
|---|---|---|
| JP | 2003273643 | 9/2003 |
| JP | 2003283232 | 10/2003 |
| JP | 2004-023369 | 1/2004 |
| JP | 2004-096618 | 3/2004 |
| JP | 2004-201278 | 7/2004 |
| JP | 2004201278 | 7/2004 |
| JP | 2005-203878 | 7/2005 |
| JP | 2005-295493 | 10/2005 |
| JP | 2006-042111 | 2/2006 |
| JP | 2006-101486 | 4/2006 |
| JP | 2006-166994 | 6/2006 |
| JP | 2006-196994 | 7/2006 |
| JP | 2006238269 | 9/2006 |
| JP | 2006-279530 | 10/2006 |
| JP | 2007-123982 | 5/2007 |
| JP | 2007129597 | 5/2007 |
| JP | 2007-142895 | 6/2007 |
| JP | 2008-28734 | 2/2008 |
| JP | 2008-042539 | 2/2008 |
| JP | 2008-160411 | 7/2008 |
| JP | 2008-177668 | 7/2008 |
| JP | 2008-199688 | 8/2008 |
| JP | 2008-271468 | 11/2008 |
| JP | 2008-283464 | 11/2008 |
| JP | 2008-283493 | 11/2008 |
| JP | 2009-033548 | 2/2009 |
| JP | 2009077225 | 4/2009 |
| JP | 2009-246560 | 10/2009 |
| JP | 2010-41071 | 2/2010 |
| JP | 2010-153973 | 7/2010 |
| JP | 2010-526471 | 7/2010 |
| JP | 2010232820 | 10/2010 |
| JP | 2011-519542 | 7/2011 |
| WO | WO 2008-013021 | 1/2008 |

OTHER PUBLICATIONS

Jiunn-Nan Hwang et al: "Isolation Enhancement Between Two Packed Antennas With Coupling Element", IEEE Antennas and Wireless Propagation Letters, IEEE, Piscataway, NJ, US, vol. 10, Jan. 1, 2011, pp. 1263-1266, XP11403146, ISSN: 1536-1225, DOI: 10.1109/LAWP.2011.2174957.

Shuai Zhang et al: "Ultrawideband MIMO/Diversity Antennas With a Tree-Like Structure to Enhance Wideband Isolation", IEEE Antennas and Wireless Propagation Letter, IEEE, Piscataway, NJ, US, vol. 8, Jan. 1, 2009, pp. 1279-1282, XP011331166, ISSN: 1536-1225, DOI: 10.1109/LAWP.2009.2037027.

Andrenko A S et al: "Low Correlation Antenna Design for Diversity Handset Applications", Microwave Conference, 2008. APMC 2008. Asia-Pacific, IEEE, Piscataway, NJ, USA, Dec. 16, 2008, pp. 1-4, XP031637073, ISBN: 978-1-4244-2641-6.

Cui S et al: "Compact dual-Band Monopole Antennas with High Port Isolation", Electronic Letters, The Institution of Engineering and Technology, vol. 47, No. 10, May 12, 2011, pp. 579-580, XP006038874, ISSN: 1350-911X, DOI: 10.1049/EL:20103603.

* cited by examiner

< Frequency characteristics of imaginary part of antenna impedance >

<Model 01>

<Model 02>

<Model 03>

<Frequency characteristics of imaginary part of antenna impedance>

<Frequency characteristics of VSWR>

<Frequency characteristics of imaginary part of antenna impedance>

When element is fold

When two or more stubs are provided

When element is formed wide near feeding terminal

When element is formed wide near ground terminal

When position of ground terminal is offset

<First modification of folded monopole element>

When distal end of folded monopole element is formed into meandering shape

When one distal end extends from midway position

When element is formed wide near feeding terminal

When distal end is formed wide

When lumped parameter elements are implemented in elements

<Second modification folded monopole element>

When element is fold

When distal end is formed wide

When midway portion of element is connected to folded monopole element

When distal end is branched into two or more portions

When element is branched from position near feeding point

<First modification of monopole element>

When distal end portion of element is formed into meandering shape

When root portion is formed wide

When one or more monopole elements are added

When lumped parameter element is implemented in element

<Second modification of monopole element>

When element is fold

When distal end portion is formed into meandering shape

When distal end portion is formed wide

When distal end portion is branched

When one or more parasitic elements are added

<First modification of parasitic element>

When middle portion is formed into meandering shape

When root portion is formed wide

When distal end is branched

When lumped parameter element is implemented in element

<Second modification of parasitic element>

When parasitic element is added on ground terminal side of folded monopole element When parasitic element is added on ground terminal side of folded monopole element (ground terminal is shared between folded monopole element and parasitic element)

<Modification of embodiment including additional parasitic element>

ANTENNA DEVICE AND ELECTRONIC DEVICE INCLUDING ANTENNA DEVICE

CROSS-REFERENCE TO RELATED APPLICATIONS

This application is based upon and claims the benefit of priority from prior Japanese Patent Application No. 2011-076288, filed Mar. 30, 2011, the entire contents of which are incorporated herein by reference.

FIELD

Embodiments described herein relate generally to an antenna device and an electronic device including the antenna device.

BACKGROUND

Recently, the housings of portable terminal devices typified by cellular phones, smart phones, Personal Digital Assistants (PDAs), and tablet type terminals have been required to reduce the dimensions and weight from the viewpoint of compactness and lightweightness. Accordingly, demands have arisen for more compact antenna devices. It has also been required to allow a single portable terminal device to communicate with a plurality of radio systems using different frequency bands.

Conventionally, therefore, a multifrequency antenna device has been proposed, which has, for example, the second antenna element formed from a monopole element and provided in a direction opposite to the first antenna element formed from a folded element with a stub at a position near the feeding point of the first antenna element.

In these conventionally provided multifrequency antenna devices, although it is possible to independently adjust the first resonance caused by the folded element and the second resonance caused by the monopole element, there occurs a band in which radiation efficiency deteriorates due to parallel resonance between the first resonance and the second resonance, resulting in difficulty in achieving wider bandwidth.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an antenna device includes a first antenna element formed from a folded monopole element, a second antenna element formed from a monopole element, and a third antenna element formed from a parasitic element.

One end of the first antenna element is connected to a feeding terminal, and the other end is connected to a first ground terminal. The first antenna element is folded in the middle, with a stub being provided between the forward and backward portions formed by folding.

One end of the second antenna element is connected to the above feeding terminal directly or through part of the first antenna element, and the other end is open.

One end of the third antenna element is connected to a second ground terminal provided at a position on the opposite side to the first ground terminal through the feeding terminal, and the other end is open.

The electrical length of the first antenna element from the feeding terminal to the first ground terminal through the other end of the folding portion is set to nearly ½ a wavelength corresponding to a predetermined first resonance frequency.

The electrical length of the second antenna element from the feeding terminal to the other end is set to nearly ¼ a wavelength corresponding to a predetermined second resonance frequency.

The third antenna element is placed parallel to the second antenna element in a state in which at least part of the third antenna element can be capacitively coupled to the second antenna element. The electrical length of the third antenna element from the second ground terminal to the other end is set to nearly ¼ a wavelength corresponding to a predetermined third resonance frequency.

The antenna device having the above arrangement can prevent the occurrence of parallel resonance between a plurality of series resonance bands. This can implement wider resonance bands.

First Embodiment

Figure 1:
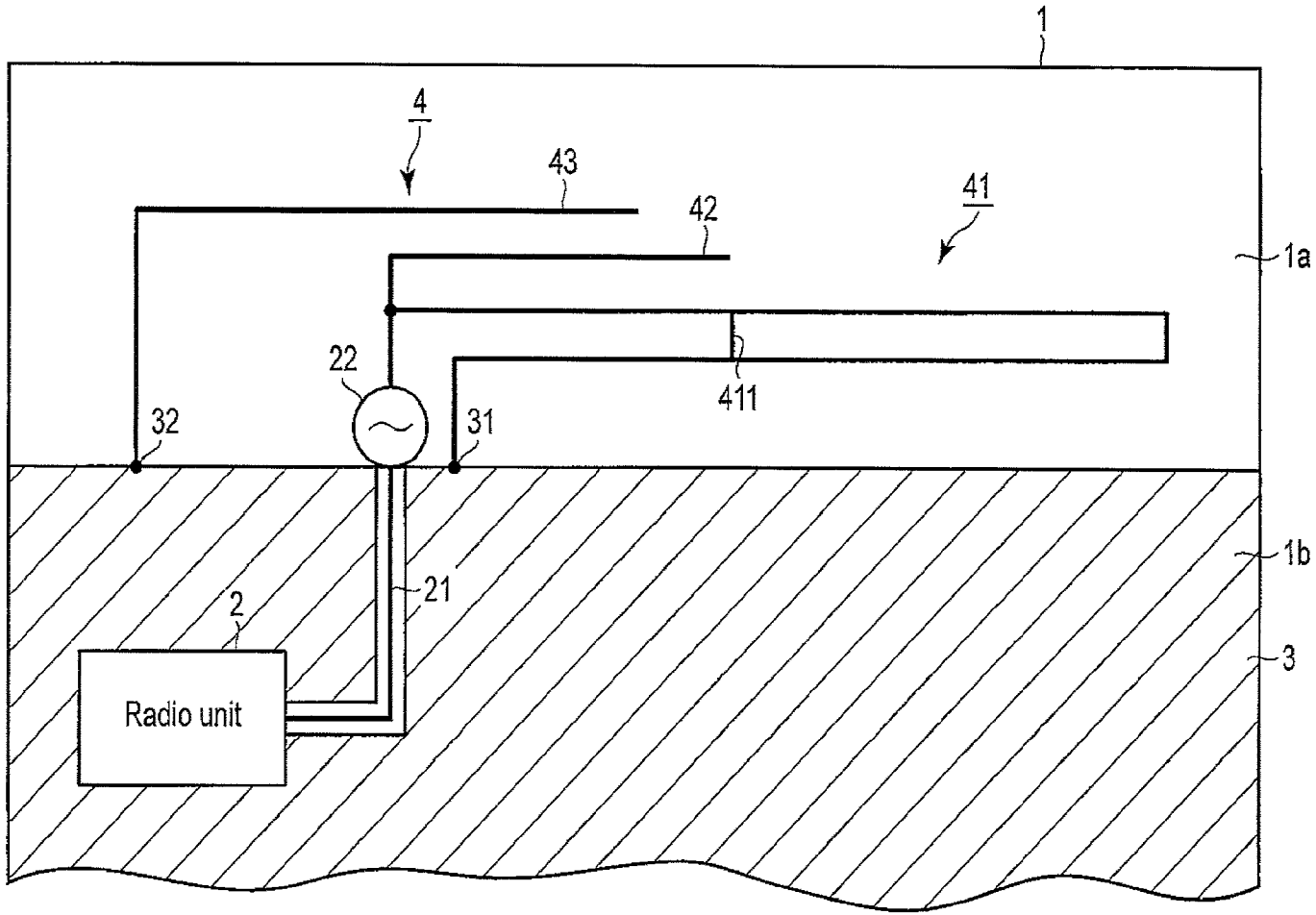
FIG. 1 is a view showing the arrangement of an electronic device including an antenna device according to the first embodiment.

FIG. 1 is a view showing the arrangement of the main components of an electronic device including an antenna device according to the first embodiment. This electronic device includes a notebook personal computer or television receiver including a radio interface. The housing (not shown) of this device accommodates a printed circuit board 1.

Note that the electronic device may be a portable terminal such as a cellular phone, smart phone, PDA (Personal Digital Assistant), or tablet type terminal other than a notebook personal computer or television receiver. The printed circuit board 1 may be formed as part of the metal housing or formed from a metal member such as a copper foil.

The printed circuit board 1 includes a first area 1*a* and a second area 1*b*. The first area 1*a* is provided with an antenna device 4. A ground pattern 3 is formed in the second area 1*b*. In addition, first and second ground terminals 31 and 32 are provided in the second area 1*b*. Note that a plurality of circuit modules required to constitute an electronic device are mounted on the rear surface side of the printed circuit board 1.

The circuit module includes a radio unit 2. The radio unit 2 has a function of transmitting and receiving radio signals by using the channel frequency assigned to a radio system as a communication target. The first area 1*a* is provided with a feeding terminal 22. The radio unit 2 is connected to the feeding terminal 22 through a feeding pattern 21.

The antenna device 4 has the following arrangement.

The antenna device 4 includes a folded monopole element 41 as the first antenna element, a monopole element 42 as the second antenna element, and a parasitic element 43 as the third antenna element. The elements 41, 42 and 43 are arranged such that the folded monopole element 41 is placed at a position nearest to the ground pattern 3, and the monopole element 42 and the parasitic element 43 are placed outside the monopole element 41 in increasing order of distance from the ground pattern 3.

The folded monopole element 41 is formed from a conductive pattern having a shape obtained by folding the element in a hairpin form at a position dividing the entire element into almost two equal portions, with one end of the element being connected to the feeding terminal 22, and the other end being connected to the first ground terminal 31. A stub 411 is provided between the forward and backward portions formed by folding the element. The element length of the folded monopole element 41, that is, the electrical length from the feeding terminal 22 to the first ground terminal 31 through the folding position, is set to nearly ½ a wavelength corresponding to a predetermined first resonance frequency f1.

The monopole element 42 is formed from an L-shaped conductive pattern having a proximal end connected to the feeding terminal 22 through part of the folded monopole element 41, and a distal end open. The element length of the monopole element 42, that is, the electrical length from the feeding terminal 22 to the distal end, is set to nearly ¼ a wavelength corresponding to a predetermined second resonance frequency f2.

The parasitic element 43 is formed from an L-shaped conductive pattern having a proximal end connected to the ground terminal 32, and a distal end open. The element length of the parasitic element 43, that is, the electrical length from the ground terminal 32 to the distal end, is set to a length nearly ¼ a wavelength corresponding to a predetermined third resonance frequency f3. The parasitic element 43 is also placed parallel to the monopole element 42 such that at least part of the horizontal portion of the parasitic element 43 on the distal end side can be current-coupled to the horizontal portion of the monopole element 42.

The first resonance frequency f1 is set in the band (700 MHz to 900 MHz) used by, for example, a radio system using LTE (Long Term Evolution). The second resonance frequency f2 is set in the band (1.7 GHz to 1.9 GHz) used by a radio system based on the 3G standard. The third resonance frequency f3 is set in a band near the first resonance frequency f1 or the second resonance frequency f2 to expand the band used by the above radio system using LTE or the band used by the radio system based on the 3G standard.

Figure 2:
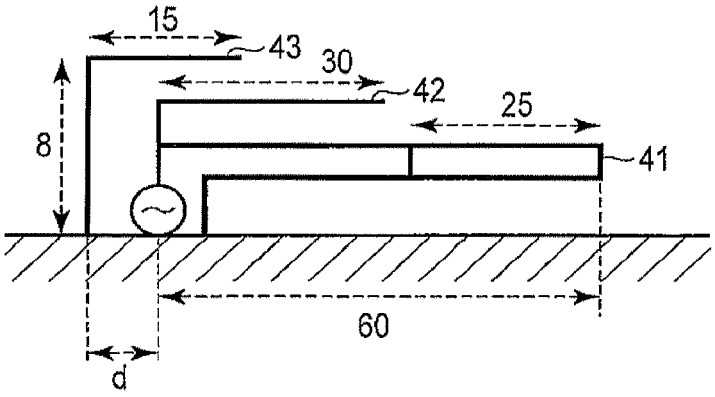
FIG. 2 is a view showing an example of the antenna device shown in FIG. 1.

The element lengths of the folded monopole element 41 with the stub, monopole element 42, and parasitic element 43 and their relative positions are set to lengths that are necessary to generate the first, second, and third resonance frequencies f1, f2, and f3. FIG. 2 shows an example of an antenna device configured to satisfy this condition. The numbers in FIG. 2 represent the dimensions (unit: mm) of the respective antenna element portions.

Figure 3:
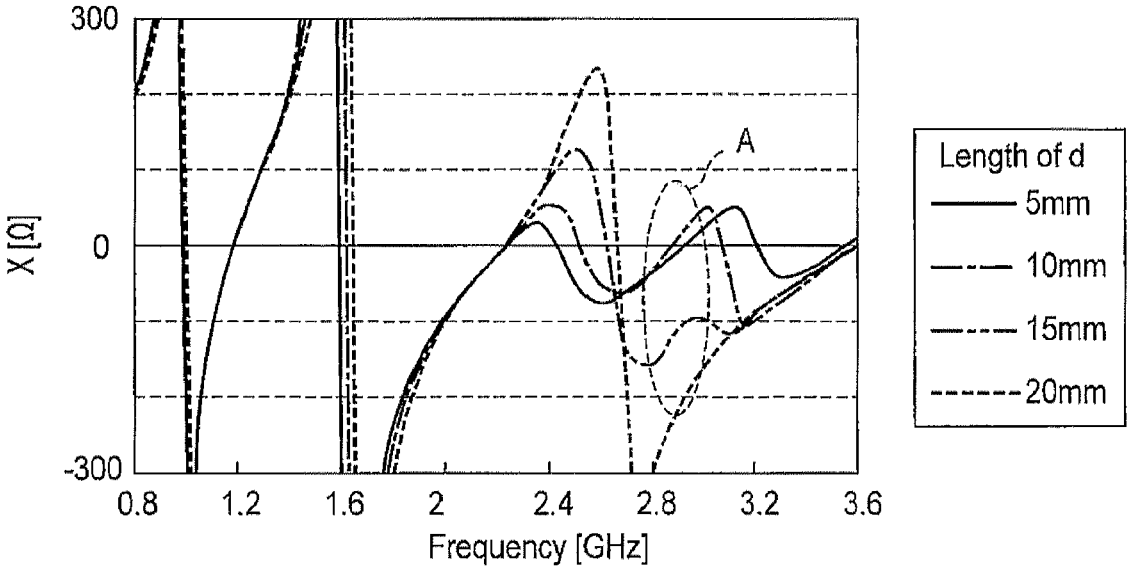
FIG. 3 is a graph showing the frequency characteristics of the imaginary part of the antenna impedance of the antenna device shown in FIG. 2.

In order to generate the third resonance frequency f3 on the parasitic element 43, the parasitic element 43 needs to be placed such that at least part of the distal end horizontal portion of the parasitic element 43 becomes parallel to the horizontal portion of the monopole element 42. In order to check this condition, the present applicant analyzed the frequency characteristics of the imaginary parts of antenna impedances obtained when setting the distance (d in FIG. 2) between the feeding terminal 22 and the ground terminal 32, to which the parasitic element 43 is grounded, to 5 mm, 10 mm, 15 mm, and 20 mm. FIG. 3 shows an example of the analysis result.

As is obvious from FIG. 3, when the distance d becomes larger than 15 mm, that is, the length of the portion of the parasitic element 43 which is parallel to the monopole element 42 becomes equal to or less than 0 mm, the parasitic element 43 cannot maintain a capacitively coupled state with the monopole element 42. As a consequence, it becomes impossible to cause resonance, as indicated by "A" in FIG. 3. Obviously, therefore, it is necessary to place the parasitic element 43 so as to maintain a state in which at least the distal end portion of the parasitic element 43 is parallel to the horizontal portion of the monopole element 42.

In addition, the antenna device 4 of the first embodiment can independently adjust the third resonance frequency f3 by changing the element length of the parasitic element 43. In order to check this effect, the present applicant prepared three kinds of models 01, 02, and 03 obtained by setting the element length of the parasitic element 43 to different lengths as shown in, for example, FIGS. 4A, 4B and 4C and analyzed the frequency characteristics of the imaginary parts of the antenna impedances of the respective models and frequency characteristics of voltage standing wave ratio (VSWR). FIGS. 5 and 6 each show an example of each analysis result.

Figure 4A:
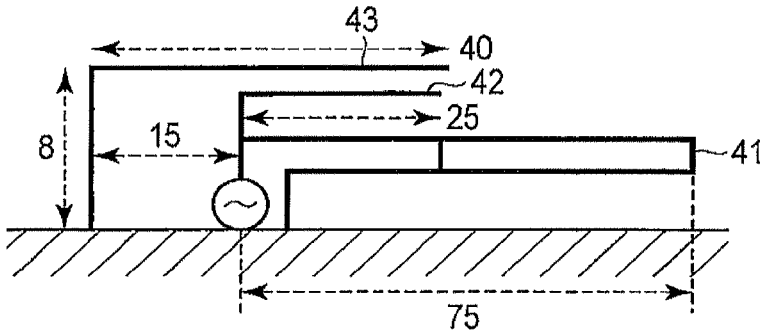
FIGS. 4A, 4B and 4C are views showing a plurality of models obtained by changing the length of the parasitic element of the antenna device shown in FIG. 1.
Figure 4B:
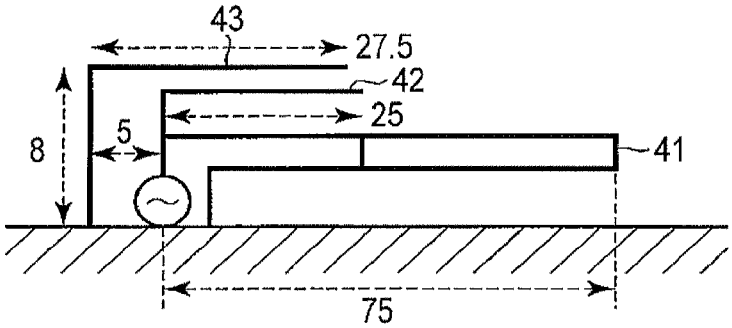
Figure 4C:
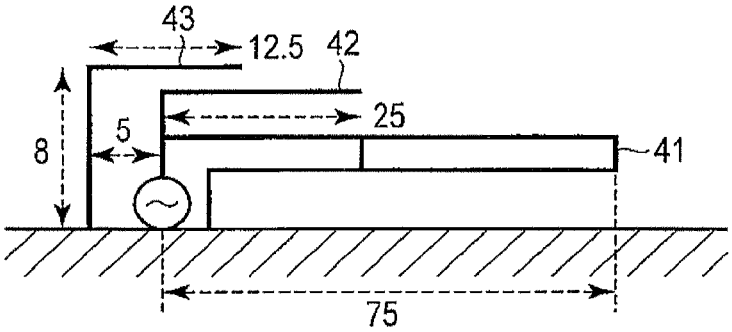
Figure 5:
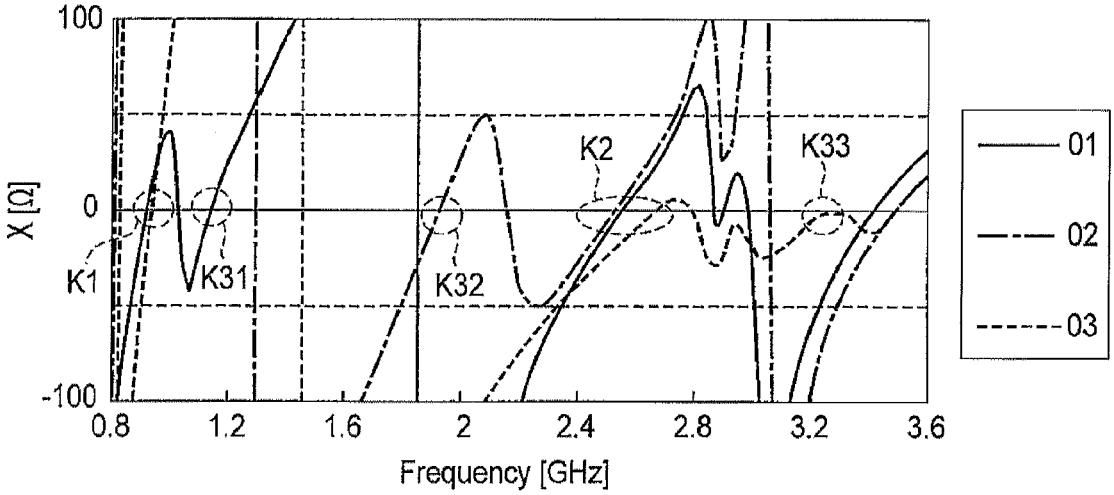
FIG. 5 is a graph showing the frequency characteristics of the imaginary parts of the antenna impedances based on the plurality of models shown in FIGS. 4A, 4B and 4C.
Figure 6:
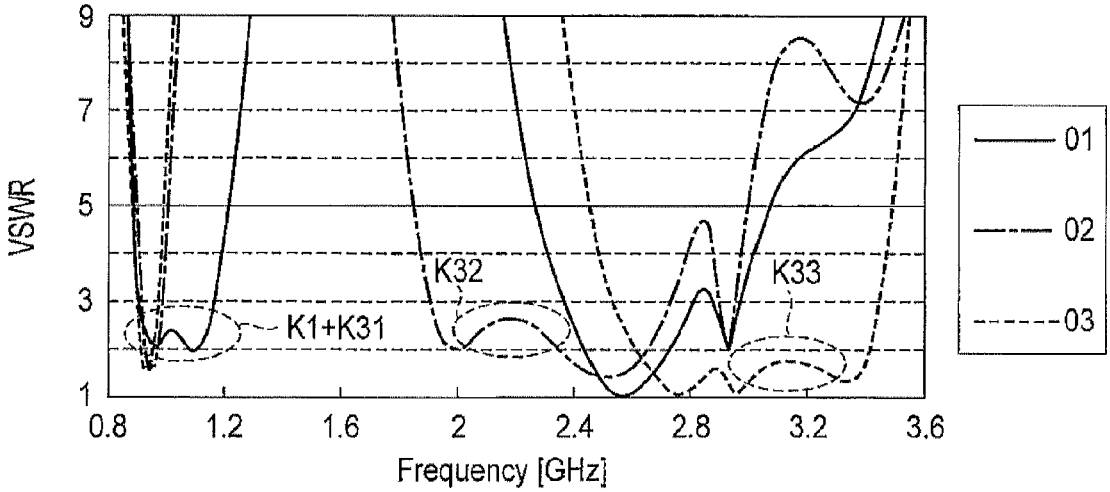
FIG. 6 is a graph showing the VSWR frequency characteristics based on the plurality of models shown in FIGS. 4A, 4B and 4C.

As is obvious from the characteristics shown in FIGS. 5 and 6, setting the length of the horizontal portion of the parasitic element 43 to a relatively large value (e.g., 40 mm) as shown in FIG. 4A can generate the third resonance frequency f3 in a low band K31 (e.g., near 1.2 GHz). In addition, setting the length of the horizontal portion of the parasitic element 43 to a value (e.g., 27.5 mm) smaller than 40 mm as shown in FIG. 4B can generate the third resonance frequency f3 in a band K32 (near 2 GHz) higher than 1.2 GHz. Furthermore, setting the length of the horizontal portion of the parasitic element 43 to a value (e.g., 12.5 mm) shorter than 27.5 mm as shown in FIG. 4C can generate the third resonance frequency f3 in a band K33 (near 3.2 GHz) higher than 2 GHz. Note that K1 and K2 in FIG. 5 represent the first and second resonance frequencies f1 and f2 generated by the folded monopole element 41 and the monopole element 42.

The parasitic element 43 causes no interference with the folded monopole element 41 and the monopole element 42. This is because the folded monopole element 41, the monopole element 42, and the parasitic element 43 are arranged in a positional relationship like that shown in FIG. 1 so as not to cause parallel resonance in bands between series resonances between the folded monopole element 41, the monopole element 42, and the parasitic element 43, thereby preventing an increase in mismatch loss and deterioration in radiation efficiency.

That is, according to the antenna device 4 described above, merely setting the element length of the parasitic element 43 to an arbitrary length can independently set the third resonance frequency f3 in an arbitrary band near the first or second resonance frequency f1 or f2 without causing any interference between the folded monopole element 41 and the monopole element 42. This can implement wider bands of the first or second resonance frequency f1 or f2.

Figure 7:
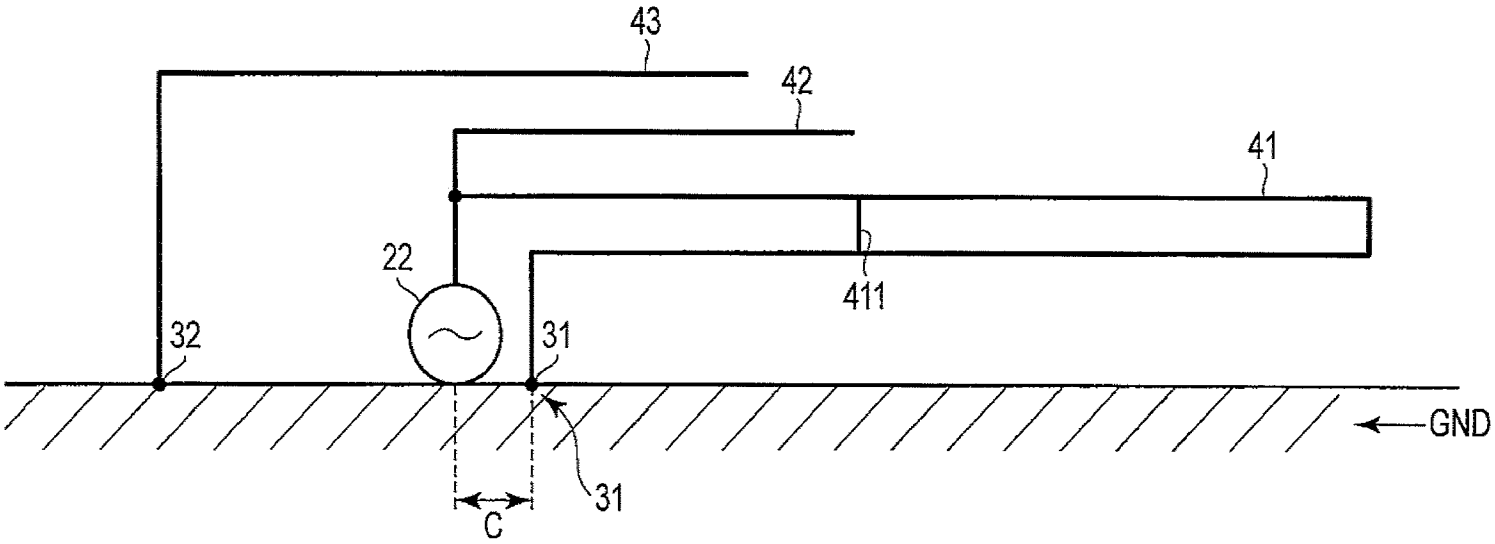
FIG. 7 is a view for explaining one of the conditions for the antenna device shown in FIG. 1.
Figure 8A:
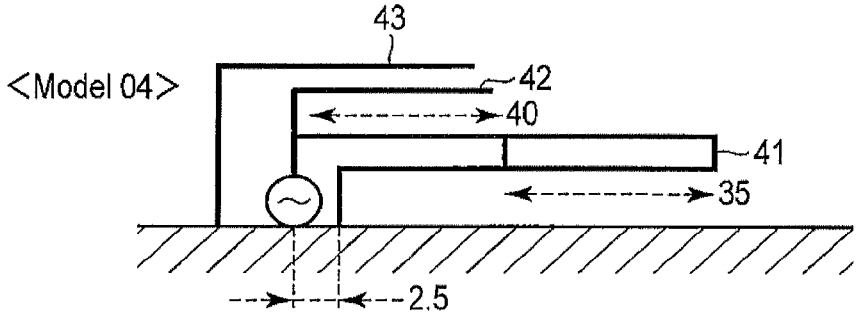
FIGS. 8A, 8B, 8C and 8D are views showing a plurality of models obtained by changing the length of the folded element of the antenna device shown in FIG. 7.
Figure 8B:
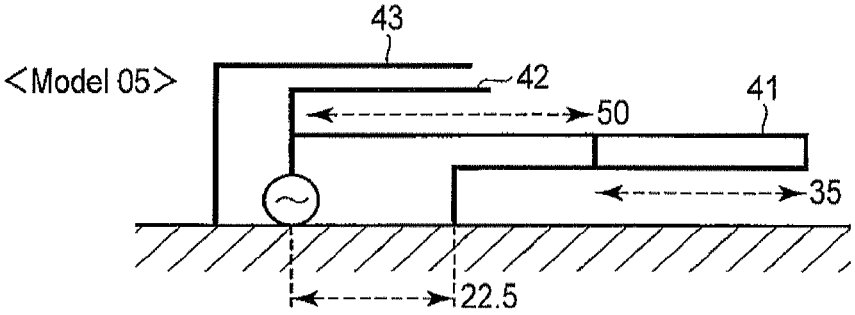
Figure 8C:
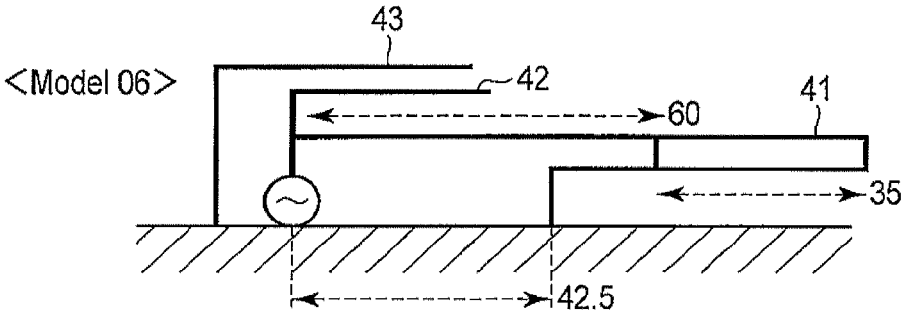
Figure 8D:
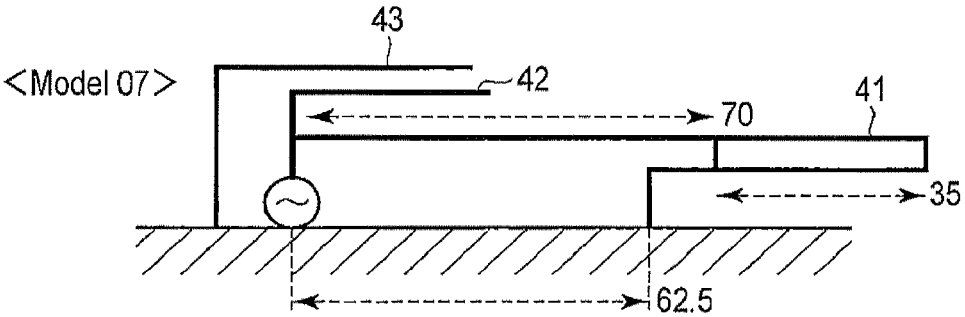
Figure 9:
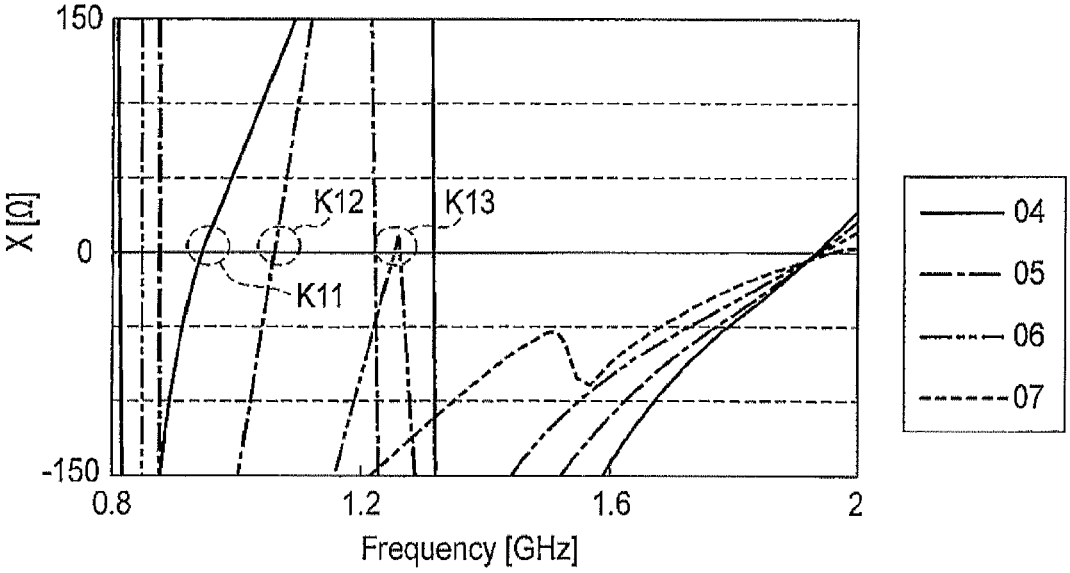
FIG. 9 is a graph showing the frequency characteristics of the imaginary parts of antenna impedances based on the plurality of models shown in FIGS. 8A, 8B, 8C and 8D.

In order to effectively obtain the above effects, a distance C between the first ground terminal 31 and the feeding terminal 22 of the folded monopole element 41 may be set to ⅕ or less a wavelength corresponding to the first resonance frequency f1 as shown in FIG. 7. In order to check this condition, the present applicant prepared four kinds of models, 04 to 07, obtained by changing the distance C as shown in, for example, FIGS. 8A, 8B, 8C and 8D and analyzed the frequency characteristics of the imaginary parts of the antenna impedances of the respective models. FIG. 9 shows an example of the analysis result.

As is obvious from the analysis result shown in FIG. 9, in the models 04 to 06 with the distance C being set to be relatively short, series resonances K11, K12 and K13 occur owing to the folded monopole element 41. However, in the model 07 with the distance C being set to be long, no sufficient series resonance occurs, and hence the first resonance frequency f1 cannot be set.

As described in detail above, according to the first embodiment, the folded monopole element 41 with the stub, the monopole element 42, and the parasitic element 43 are arranged in increasing order of distance from the ground pattern 3, and the parasitic element 43 is placed so as to make at least part of its distal end horizontal portion become parallel to the horizontal portion of the monopole element 42, thereby generating the third resonance frequency f3 on the parasitic element 43.

Therefore, merely setting the element length of the parasitic element 43 to an arbitrary length in the above manner can independently set the third resonance frequency f3 in an arbitrary band near the first or second resonance frequency f1 or f2 without causing any interference between the folded monopole element 41 and the monopole element 42. This can implement wider bands of the first or second resonance frequency f1 or f2.

Second Embodiment

Figure 10:
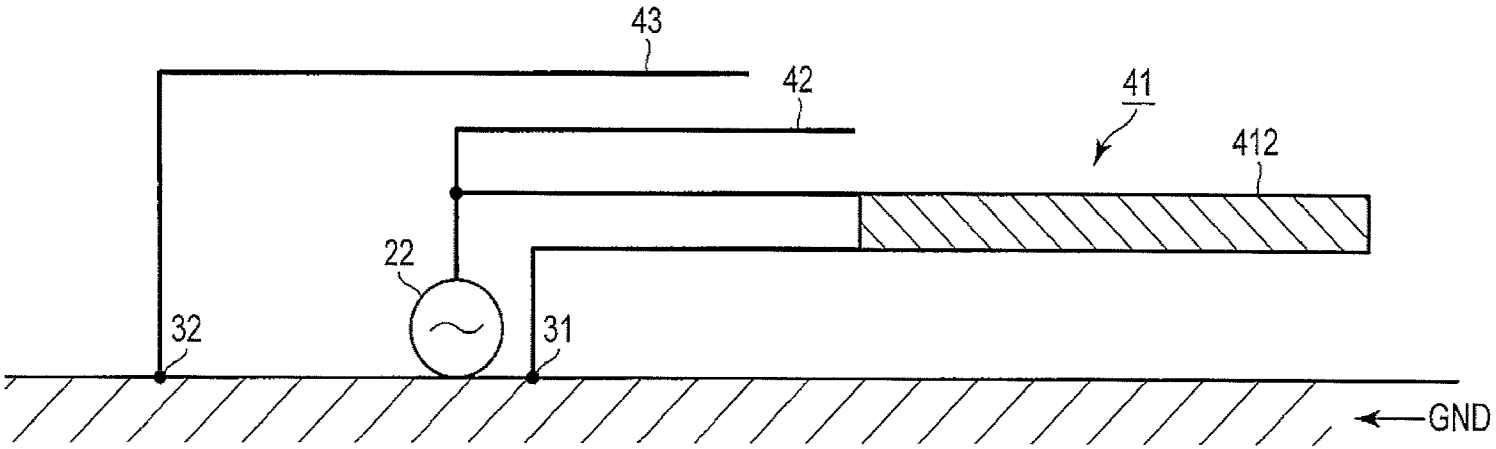
FIG. 10 is a view showing the arrangement of an antenna device according to the second embodiment.

FIG. 10 is a view showing the arrangement of an antenna device according to the second embodiment. The same reference numerals as in FIG. 10 denote the same parts in FIG. 1, and a detailed description of them will be omitted.

The section extending from the stub installation position to the folding position of a folded monopole element 41 with a stub is formed from one element 412 having a plate-like shape. Note that the element 412 may have a rod-like shape other than a plate-like shape.

This arrangement can increase the structural strength of the section of the folded monopole element 41 which extends from the stub to the folding position, and hence can increase the yield in manufacturing an antenna device 4.

Third Embodiment

Figure 11:
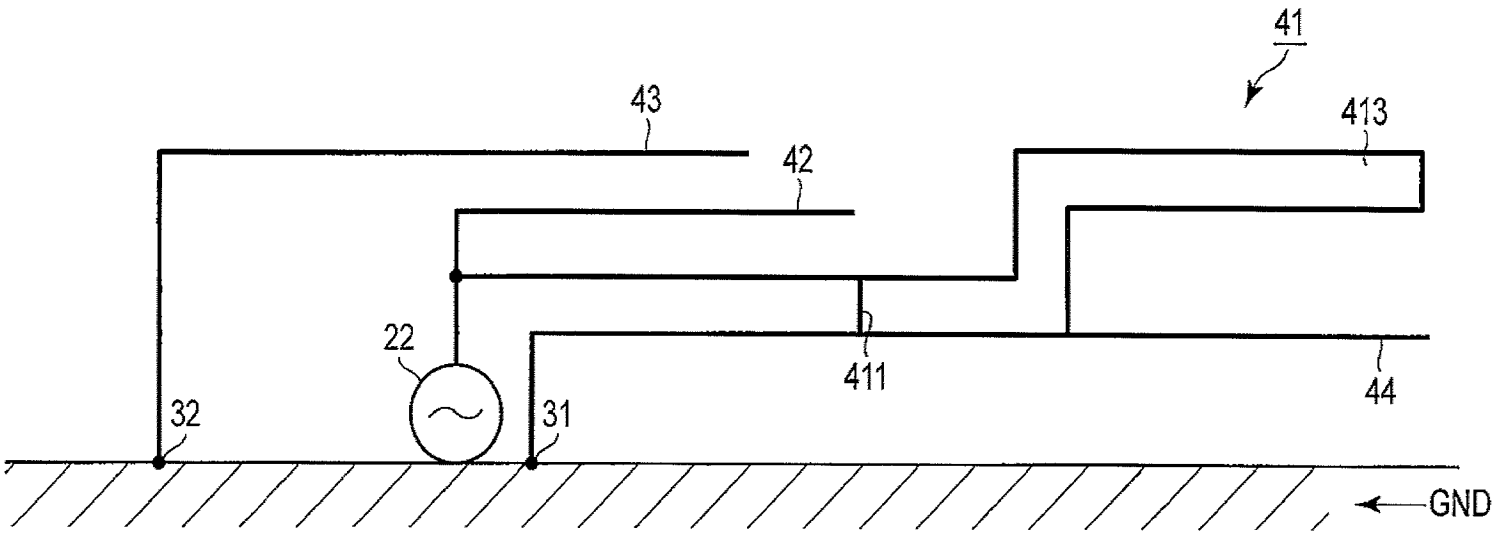
FIG. 11 is a view showing the arrangement of an antenna device according to the third embodiment.

FIG. 11 is a view showing the arrangement of an antenna device according to the third embodiment. The same reference numerals as in FIG. 11 denote the same parts in FIG. 1, and a detailed description of them will be omitted.

A folded monopole element 41 is formed by folding its section extending from the stub installation position to the folding position in a crank shape, with one additional element 44 being provided at a position corresponding to the root portion of the crank shape.

Figure 12:
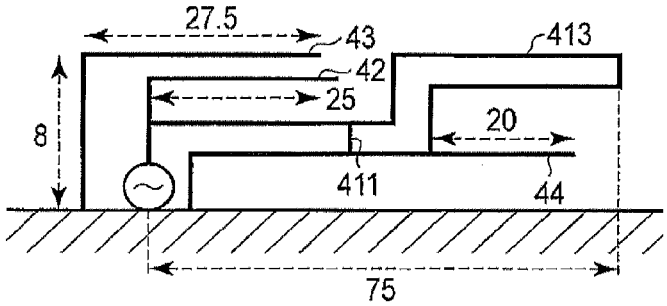
FIG. 12 is a view showing an example of the antenna device shown in FIG. 11.
Figure 13:
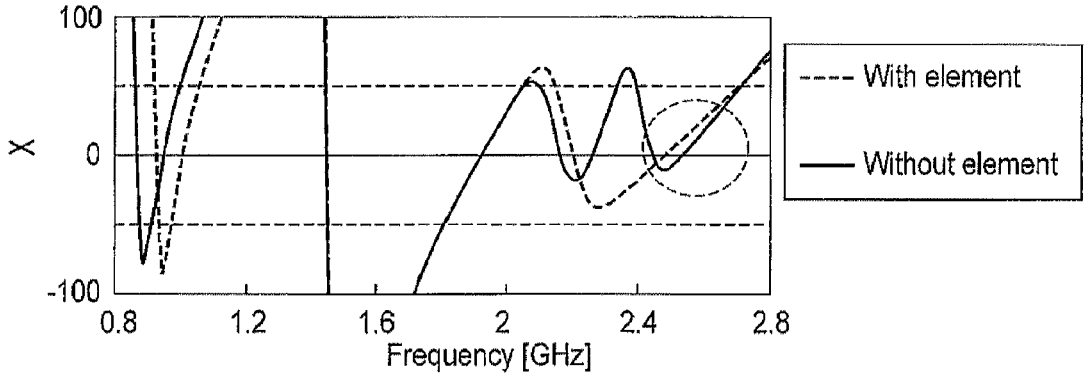
FIG. 13 is a graph showing the frequency characteristics of the imaginary part of the antenna impedance in the example shown in FIG. 12.
Figure 14:
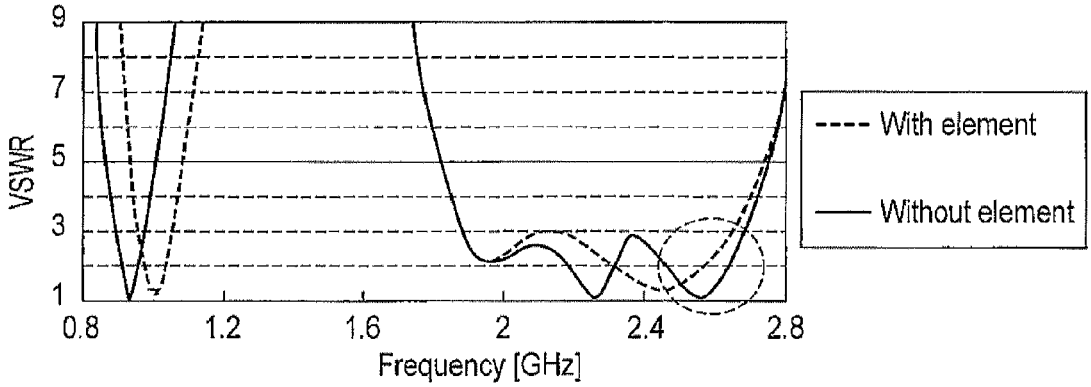
FIG. 14 is a graph showing VSWR frequency characteristics in the example shown in FIG. 12.

FIG. 12 shows a specific arrangement of this monopole element. The numbers in FIG. 12 represent the dimensions (unit: mm) of the respective antenna element portions. FIGS. 13 and 14 show the results obtained by analyzing the frequency characteristics of the imaginary part of the antenna impedance and voltage standing wave ratio (VSWR) frequency characteristic. FIGS. 13 and 14 show also characteristics obtained without using the additional element 44.

As is obvious from FIGS. 13 and 14, providing the additional element 44 can also generate a resonance frequency at near 2.5 GHz. This allows the antenna device 4 to cope with a larger number of resonances. In addition, this can continuously expand the multiple resonance band from 2.0 GHz to 2.5 GHz.

Fourth Embodiment

Figure 15:
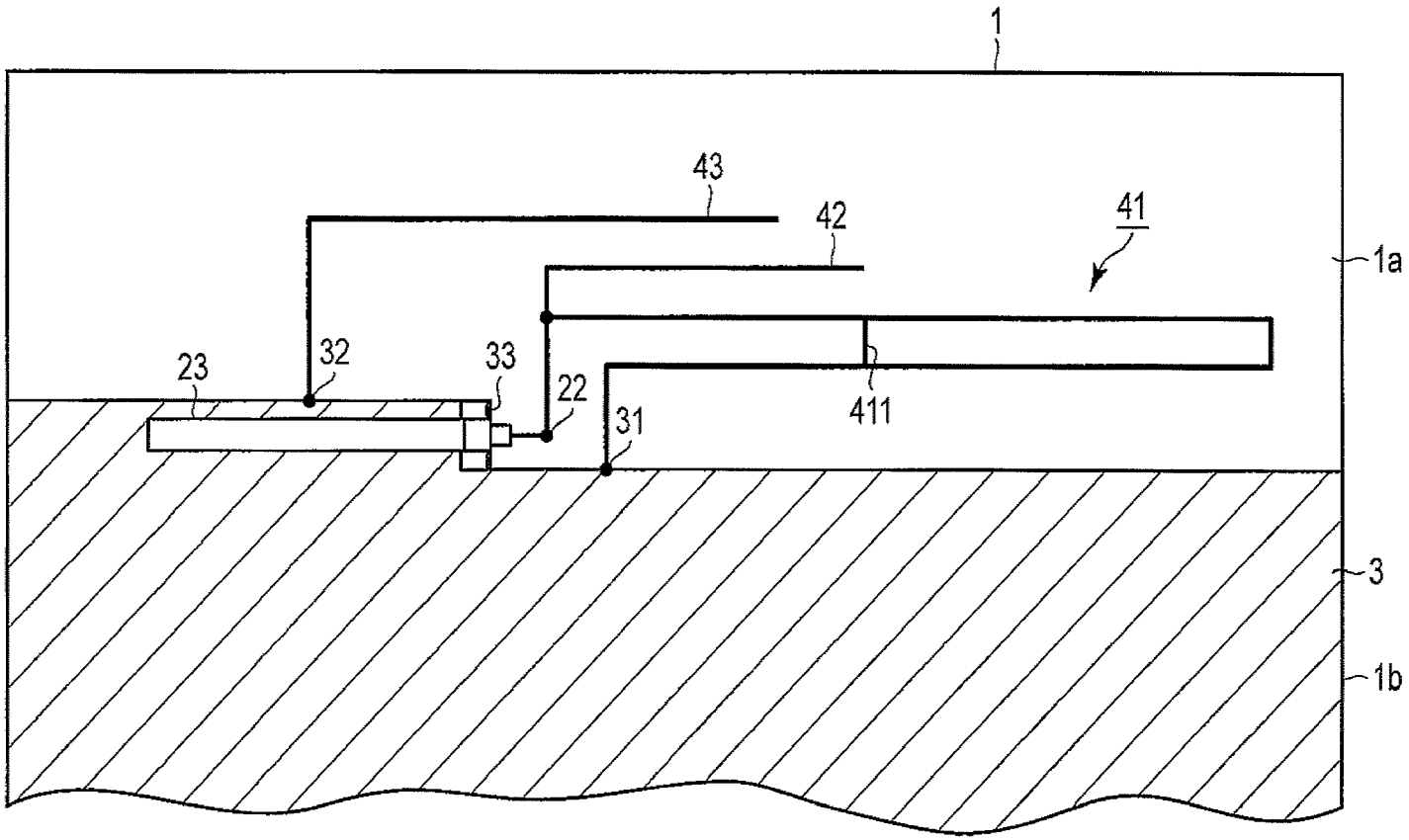
FIG. 15 is a perspective view showing the arrangement of an antenna device according to the fourth embodiment.

FIG. 15 is a view showing the arrangement of an antenna device according to the fourth embodiment. The same reference numerals as in FIG. 15 denote the same parts in FIG. 1, and a detailed description of them will be omitted.

A ground pattern 3 formed on a printed circuit board 1 has a side in a crank shape which is in contact with a first area 1*a*. A feeding cable 23 is placed along a side of the portion on the ground pattern 3 which is formed into the crank shape so as to protrude into the first area 1*a*. The feeding cable 23 is formed from a coaxial cable obtained by shielding a conductive line 24, and the shielded line is grounded to a ground terminal 33 provided on the ground pattern 3.

In addition, a portion of the first area 1*a* which protrudes into a second area 1*b* by forming the ground pattern 3 into a crank shape is provided with a feeding terminal 22. The distal end portion of the conductive line 24 of the feeding cable 23 is electrically connected to the feeding terminal 22 through a means such as soldering.

This arrangement allows to place the feeding cable 23 along a side of the ground pattern 3 without forcibly bending the feeding cable 23. This can improve the implementation efficiency of electronic components per unit area by effectively using the space of the printed circuit board 1, thereby further improving the reliability of the device. In addition, this arrangement can prevent the feeding cable 23 from overlapping a parasitic element 43, and hence can reduce variations in antenna characteristics owing to wiring of the feeding cable 23.

Fifth Embodiment

Figure 16:
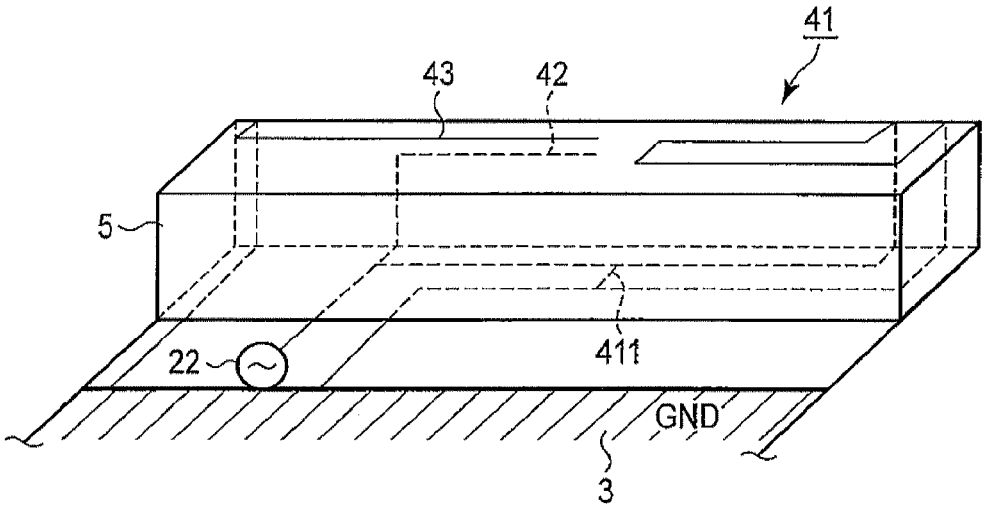
FIG. 16 is a perspective view showing the arrangement of an antenna device according to the fifth embodiment.
Figure 17:
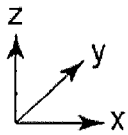
FIG. 17 is a cross-sectional view of the antenna device shown in FIG. 16.
Figure 17:
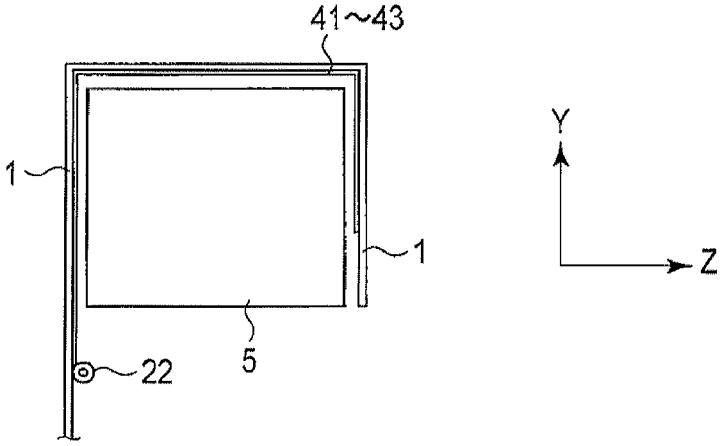

FIG. 16 is a perspective view showing the arrangement of an antenna device according to the fifth embodiment. FIG. 17 is a cross-sectional view of the antenna device shown in FIG. 16. The same reference numerals as in FIG. 17 denote the same parts in FIG. 1, and a detailed description of them will be omitted.

The antenna device according to the fifth embodiment includes a resin antenna base material (resin base material) 5. A folded monopole element 41 with a stub, a monopole element 42, and a parasitic element 43 are arranged on the circumferential surface of the resin base material 5.

More specifically, a printed circuit board 1 is formed from a flexible board. Conductive patterns respectively forming the folded monopole element 41 with the stub, the monopole element 42, and the parasitic element 43 are formed in a first area 1*a* of the printed circuit board 1 formed from this flexible board. On the other hand, the resin base material 5 is formed from a prismatic body having a longitudinal cross-section. As shown in FIG. 17, the printed circuit board 1 formed from the above flexible board as shown in FIG. 17 is wound around the circumferential surface of the resin base material 5 formed from this prismatic body.

For the sake of illustrative convenience, FIG. 17 shows that the printed circuit board 1 is spaced apart from the circumferential surface of the resin base material 5. In practice, however, the printed circuit board 1 is provided in tight contact with the resin base material 5 with an adhesive or bonding material such as a doubled-sided adhesive tape. As the resin base material 5, a columnar body, an elliptic columnar body, or a plate-like body can be used instead of a prismatic body.

This arrangement can decrease the dimensions of the printed circuit board 1 in a planar direction, and hence can downsize the antenna device 4, that is, the electronic device. In addition, arranging the folded monopole element 41 with the stub, the monopole element 42, and the parasitic element 43 on the circumferential surface of the resin base material 5 can provide a highly reliable device with structural stability.

Sixth Embodiment

Figure 18:
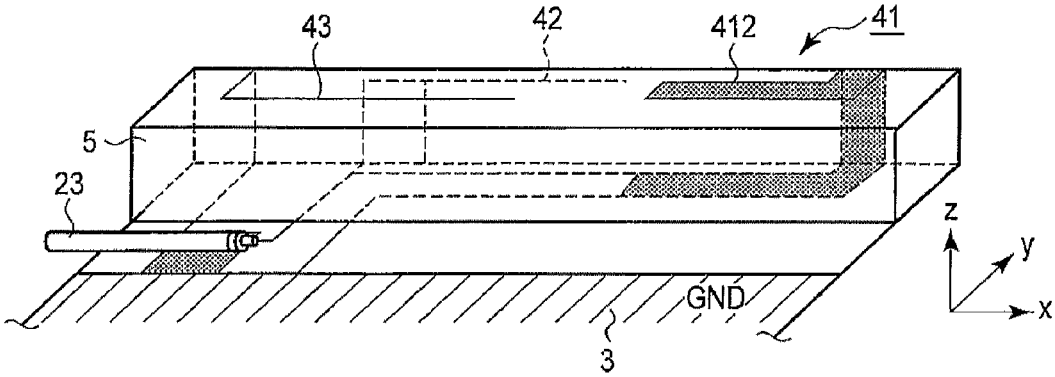
FIG. 18 is a perspective view showing the arrangement of an antenna device according to the sixth embodiment.

FIG. 18 is a perspective view showing the arrangement of an antenna device according to the sixth embodiment. The same reference numerals as in FIG. 18 denote the same parts in FIGS. 15, 16 and 17, and a detailed description of them will be omitted.

Conductive patterns respectively forming a folded monopole element 41 with a stub, a monopole element 42, and a parasitic element 43 are formed on a printed circuit board 1 formed from a flexible board. Of these elements, the folded monopole element 41 with the stub has a section extending from its stub installation position to the folding position, which is formed from one plate-like element 412. The middle position of the monopole element 42 is connected to the folded monopole element 41 through a connecting element 424. The proximal end portion of the parasitic element 43 is formed into a plate-like shape. In addition, power is fed to the folded monopole element 41 with the stub and the monopole element 42 via a feeding cable 23 formed from a coaxial cable.

Figure 19:
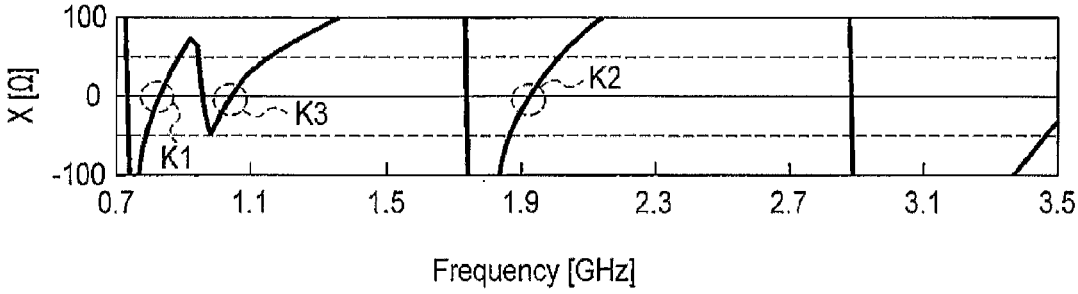
FIG. 19 is a graph showing the frequency characteristics of the imaginary part of the antenna impedance of the antenna device shown in FIG. 18.
Figure 20:
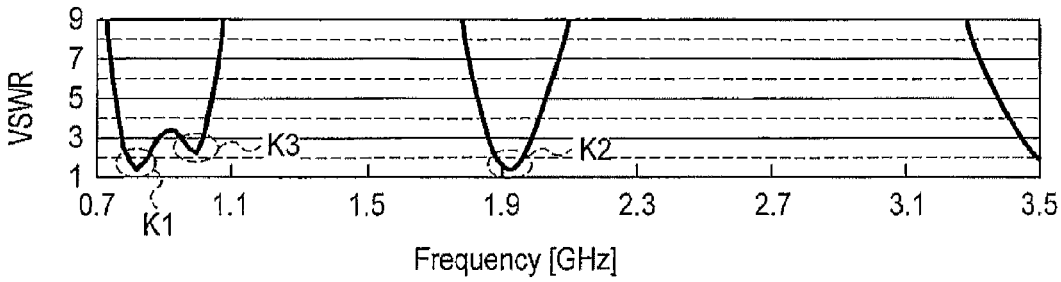
FIG. 20 is a graph showing the VSWR frequency characteristics of the antenna device shown in FIG. 18.

FIGS. 19 and 20 show an example of the results obtained by analyzing the frequency characteristics of the imaginary part of the antenna impedance and frequency characteristics of voltage standing wave ratio (VSWR) of the antenna device having the above arrangement. According to this example, a first resonance K1 occurs near 800 MHz owing to the folded monopole element 41 with the stub 411, and a third resonance K3 occurs near 1.0 GHz at a position near the first resonance K1 owing to the parasitic element 43. This can expand the resonance band from 800 MHz to 1.0 GHz. In addition, a resonance K2 occurs near 1.9 GHz owing to the monopole element 42.

Seventh Embodiment

Figure 21:
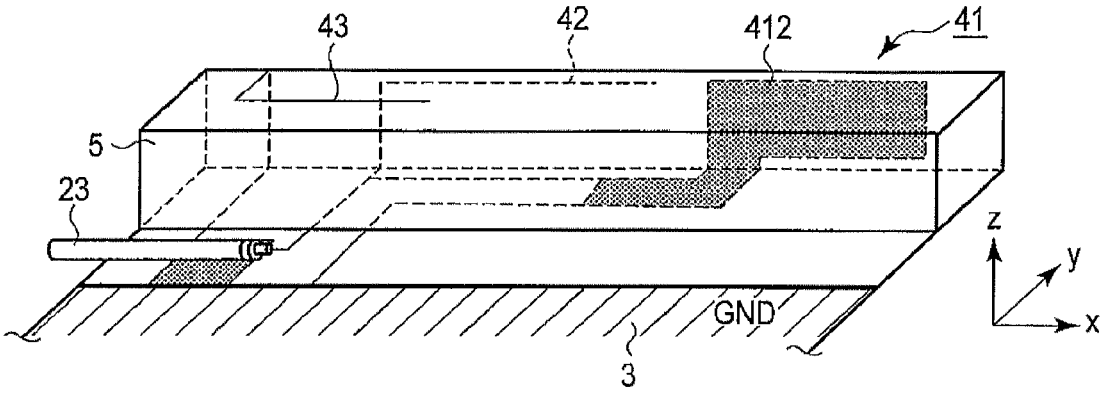
FIG. 21 is a perspective view showing the arrangement of an antenna device according to the seventh embodiment.

FIG. 21 is a perspective view showing the arrangement of an antenna device according to the seventh embodiment. The same reference numerals as in FIG. 21 denote the same parts in FIGS. 15, 16, 17 and 18, and a detailed description of them will be omitted.

Conductive patterns respectively forming a folded monopole element 41 with a stub, a monopole element 42, and a parasitic element 43 are formed on the printed circuit board 1 formed from a flexible substrate. Of these elements, the folded monopole element 41 with the stub has a section extending from its stub installation position to the folding position, which is formed from one plate-like element 412.

The plate-like element 412 has a width larger than that of the section extending from the stub installation position to a feeding terminal 22. The parasitic element 43 has a planar proximal end portion. In addition, power is fed to the folded monopole element 41 with the stub and the monopole element 42 via a feeding cable 23 formed from a coaxial cable.

Figure 22:
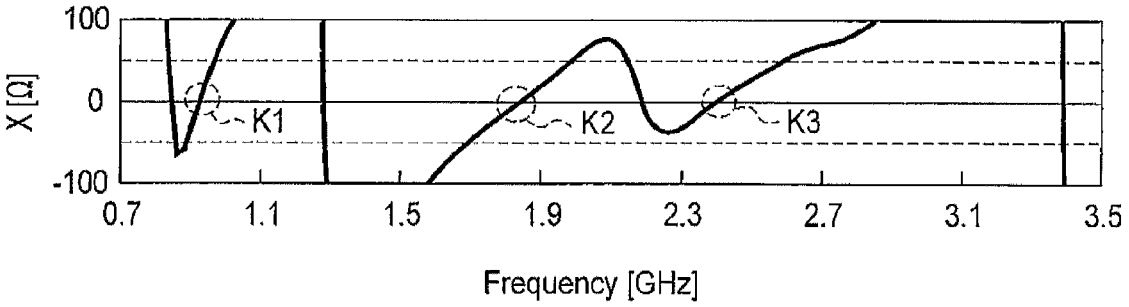
FIG. 22 is a graph showing the frequency characteristics of the imaginary part of the antenna impedance of the antenna device shown in FIG. 21.
Figure 23:
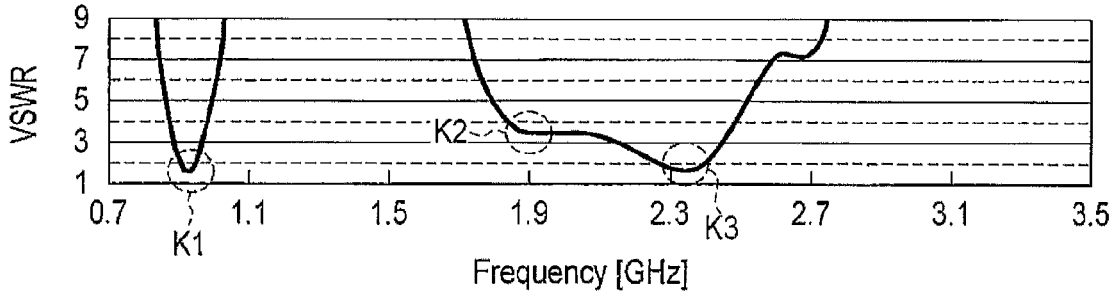
FIG. 23 is a graph showing the VSWR frequency characteristics of the antenna device shown in FIG. 21.

FIGS. 22 and 23 show an example of the results obtained by analyzing the frequency characteristics of the imaginary part of the antenna impedance and frequency characteristics of voltage standing wave ratio (VSWR) by the antenna device having the above arrangement. According to this example, a first resonance K1 occurs near 900 MHz owing to the folded monopole element 41 with the stub. A second resonance K2 occurs near 1.9 MHz owing to the monopole element 42, and a third resonance K3 occurs near 2.3 GHz at a position adjacent to the second resonance K2 owing to the parasitic element 43. This can expand the resonance band from 1.9 GHz to 2.3 GHz.

Eighth Embodiment

Figure 24:
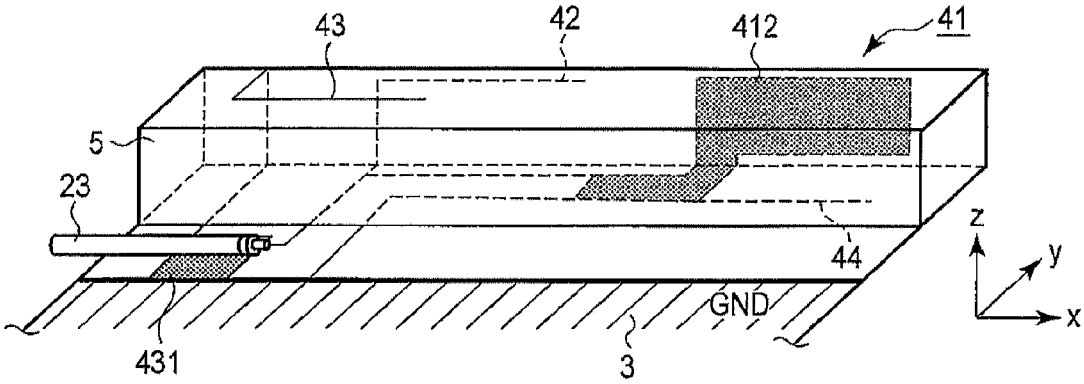
FIG. 24 is a perspective view showing the arrangement of an antenna device according to the eighth embodiment.

FIG. 24 is a perspective view showing the arrangement of an antenna device according to the eighth embodiment. The same reference numerals as in FIG. 24 denote the same parts in FIGS. 15, 16 and 17, and a detailed description of them will be omitted.

Conductive patterns respectively forming a folded monopole element 41 with a stub, a monopole element 42, and a parasitic element 43 are formed on the printed circuit board 1 formed from a flexible substrate. Of these elements, as shown in FIG. 11, the folded monopole element 41 with the stub is formed by folding its section extending from the stub installation position to the folding position in a crank shape. The section extending from this stub installation position to the folding position is formed from one element 412, and the element 412 has a width larger than the section extending from the stub installation position to a feeding terminal 22.

One additional element 44 is provided at a position corresponding to the root portion of the crank shape. The parasitic element 43 has a planar proximal end portion. In addition, power is fed to the folded monopole element 41 with the stub and the monopole element 42 via a feeding cable 23 formed from a coaxial cable.

Figure 25:
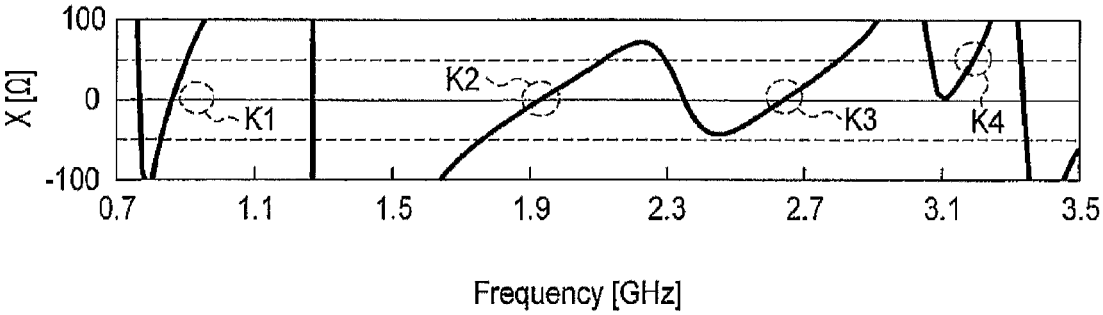
FIG. 25 is a graph showing the frequency characteristics of the imaginary part of the antenna impedance of the antenna device shown in FIG. 24.
Figure 26:
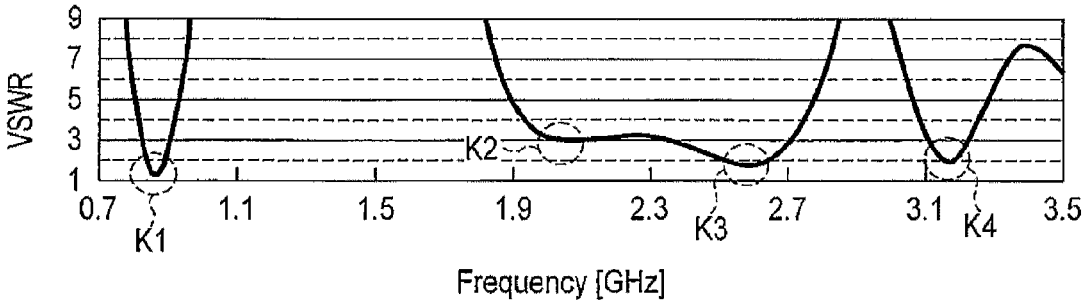
FIG. 26 is a graph showing the VSWR frequency characteristics of the antenna device shown in FIG. 24.

FIGS. 25 and 26 show an example of the results obtained by analyzing the frequency characteristics of the imaginary part of the antenna impedance and frequency characteristics of voltage standing wave ratio (VSWR) of the antenna device having the above arrangement. According to this example, a first resonance K1 occurs near 900 MHz owing to the folded monopole element 41 with the stub. A second resonance K2 occurs near 2.0 GHz owing to the monopole element 42, and a third resonance K3 occurs near 2.6 MHz at a position adjacent to the second resonance K2 owing to the parasitic element 43. This can expand the resonance band from 2.0 GHz to 2.6 GHz. In addition, a fourth resonance K4 occurs near 3.2 GHz owing to the additional element 44.

That is, this arrangement can provide a multiple resonance antenna device having a wide resonance band ranging from 2.0 GHz to 2.6 GHz.

Ninth Embodiment

Figure 27:
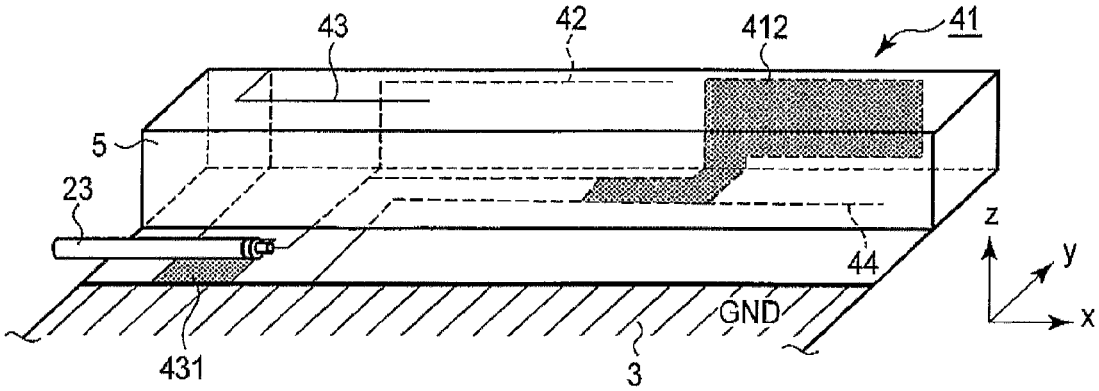
FIG. 27 is a perspective view showing the arrangement of an antenna device according to the ninth embodiment.

FIG. 27 is a perspective view showing the arrangement of an antenna device according to the ninth embodiment. The same reference numerals as in FIG. 27 denote the same parts in FIG. 24, and a detailed description of them will be omitted.

The ninth embodiment differs from the eighth embodiment in that a monopole element 42 has a longer element length.

Figure 28:
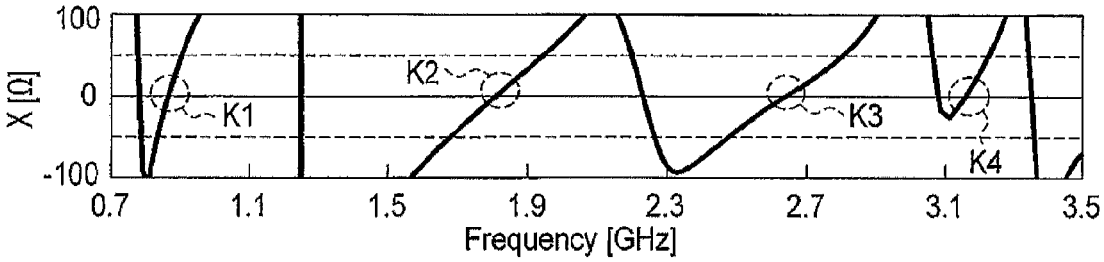
FIG. 28 is a graph showing the frequency characteristics of the imaginary part of the antenna impedance of the antenna device shown in FIG. 27.
Figure 29:
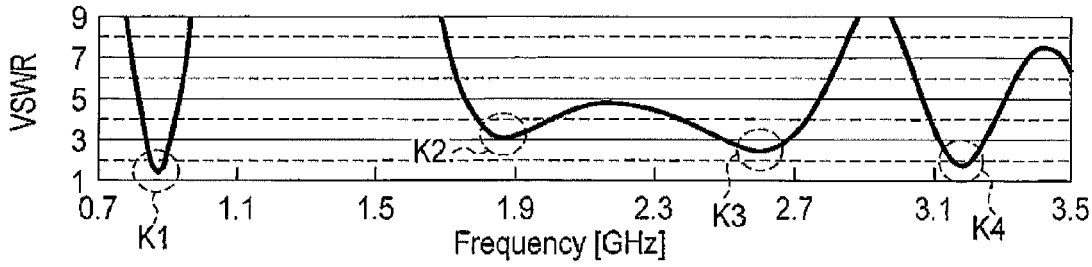
FIG. 29 is a graph showing the VSWR frequency characteristics of the antenna device shown in FIG. 27.

FIGS. 28 and 29 show an example of the results obtained by analyzing the frequency characteristics of the imaginary part of the antenna impedance and frequency characteristics of voltage standing wave ratio (VSWR) of the antenna device having the above arrangement. According to this example, it is possible to decrease the frequency of a second resonance K2 owing to the monopole element 42 to a frequency near 1.85 GHz. Therefore, the second resonance K2 owing to the monopole element 42 and a third resonance K3 owing to a parasitic element 43 can further expand a 2-GHz resonance band.

10th Embodiment

Figure 30:
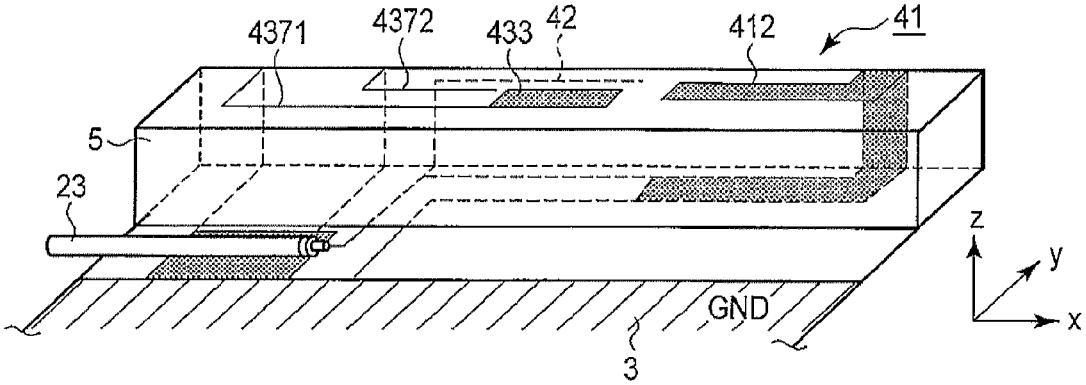
FIG. 30 is a perspective view showing the arrangement of an antenna device according to the 10th embodiment.

FIG. 30 is a perspective view showing the arrangement of an antenna device according to the 10th embodiment. The same reference numerals as in FIG. 30 denote the same parts in FIG. 18, and a detailed description of them will be omitted.

The 10th embodiment differs from the sixth embodiment in that a parasitic element 43 is branched midway into two elements 4371 and 4372 having different lengths, and the element 4371, i.e., one of the elements 4371 and 4372, has a plate-like distal end portion 433.

Figure 31:
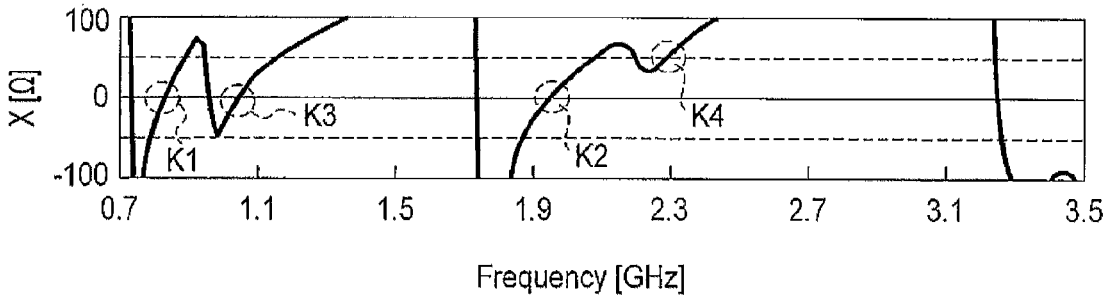
FIG. 31 is a graph showing the frequency characteristics of the imaginary part of the antenna impedance of the antenna device shown in FIG. 30.
Figure 32:
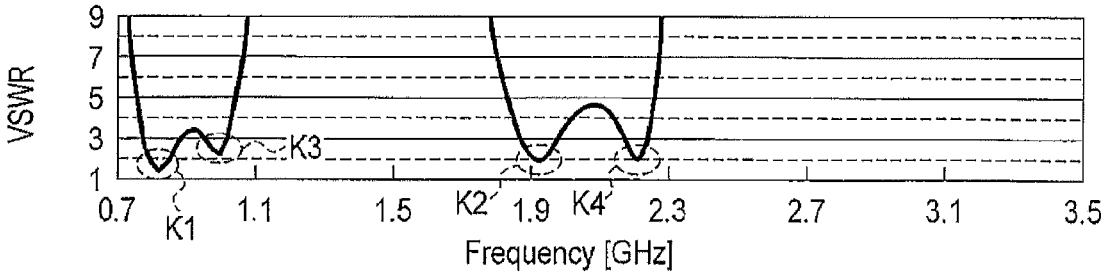
FIG. 32 is a graph showing the VSWR frequency characteristics of the antenna device shown in FIG. 30.

FIGS. 31 and 32 show an example of the results obtained by analyzing the frequency characteristics of the imaginary part of the antenna impedance and frequency characteristics of voltage standing wave ratio (VSWR) by the antenna device having the above arrangement. According to this example, a first resonance K1 occurs near 800 MHz owing to a folded monopole element 41 with a stub. A third resonance K3 occurs near 1.0 GHz at a position near the first resonance K1 owing to one parasitic element 4371. This can expand the resonance band from 800 MHz to 1.0 GHz. In addition, a second resonance K2 occurs near 1.9 GHz owing to a monopole element 42, and a fourth resonance K4 occurs near 2.2 GHz at a position near the second resonance K2 owing to the other parasitic element 4372. This can expand the resonance band from 1.9 GHz to 2.2 GHz.

Other Embodiments (1) Modification of Folded Monopole Element 41 with Stub FIGS. 33A, 33B, 33C, 33D and 33E and FIGS. 34A, 34B, 34C, 34D and 34E show various modifications of the folded monopole element 41 with the stub.

Figure 33A:
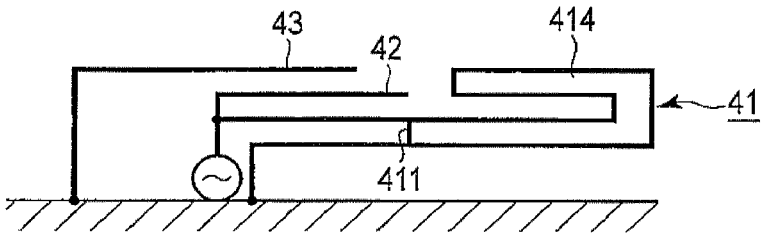
FIGS. 33A, 33B, 33C, 33D and 33E are views showing the first modification group of a folded element.

The antenna device shown in FIG. 33A is configured such that the section extending from the installation position of the stub 411 of the folded monopole element 41 with the stub to the folding end is folded. This arrangement can reduce the installation space of the antenna device in the longitudinal direction of the folded monopole element 41 with the stub even if its element length is long.

Figure 33B:
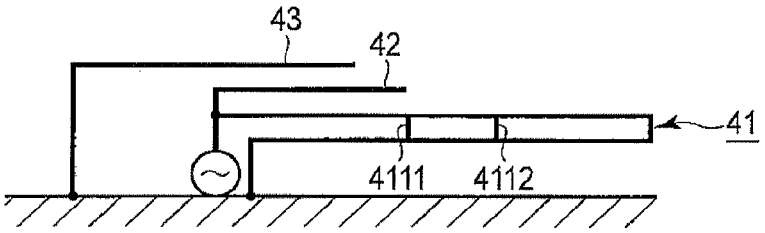

The antenna device shown in FIG. 33B has a plurality of (two in the case shown in FIG. 33B) stubs 4111 and 4112 provided between the forward and backward portions of the folded monopole element 41 with the stub which are formed by folding. This arrangement can cause a larger number of resonances.

Figure 33C:
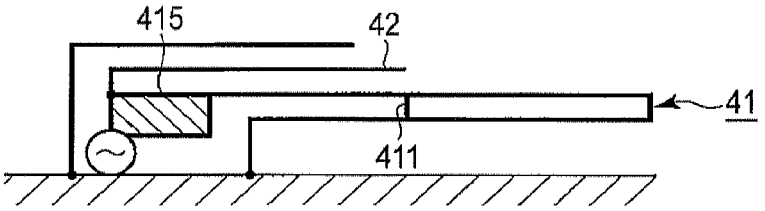

The antenna device shown in FIG. 33C is configured such that the folded monopole element 41 with the stub has a wide portion near the feeding terminal 22.

Figure 33D:
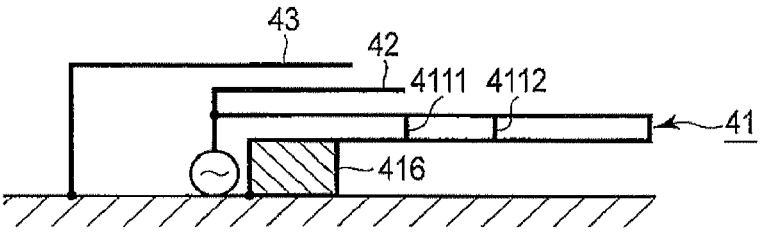

The antenna device shown in FIG. 33D is configured such that the folded monopole element 41 with the stub has a wide portion near the first ground terminal 31.

Figure 33E:
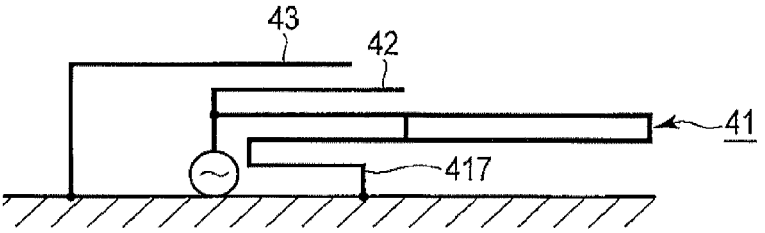

The antenna device shown in FIG. 33E is configured such that the ground position of the folded monopole element 41 with the stub relative to the ground pattern 3, i.e., the position of the first ground terminal 31, is offset in the direction of the distal end of the folded monopole element 41 with the stub.

Figure 34A:
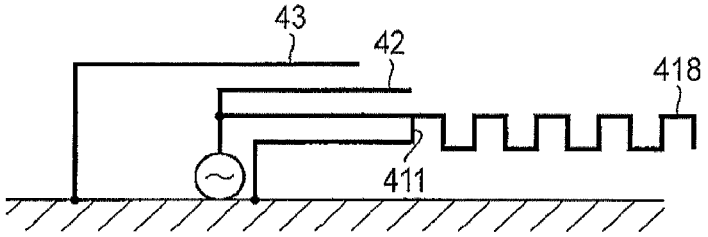
FIGS. 34A, 34B, 34C, 34D and 34E are views showing the second modification group of a folded element.

The antenna device shown in FIG. 34A is configured such that the section extending from the installation position of the stub 411 of the folded monopole element 41 with the stub to the folding end is formed from one element, which is formed into a meandering shape.

Figure 34B:
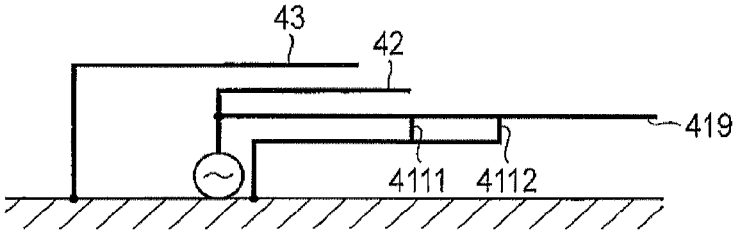

The antenna device shown in FIG. 34B is configured such that the portion between the middle portion and distal end portion of the section extending from the installation position of the stub 411 of the folded monopole element 41 with the stub to the folding end is formed from one element.

Figure 34C:
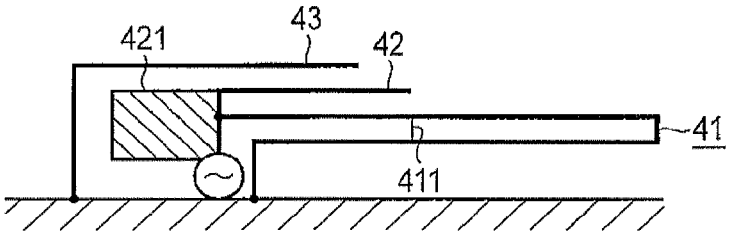

The antenna device shown in FIG. 34C is configured such that the folded monopole element 41 with the stub and the monopole element 42 have a wide portion near the feeding terminal 22.

Figure 34D:
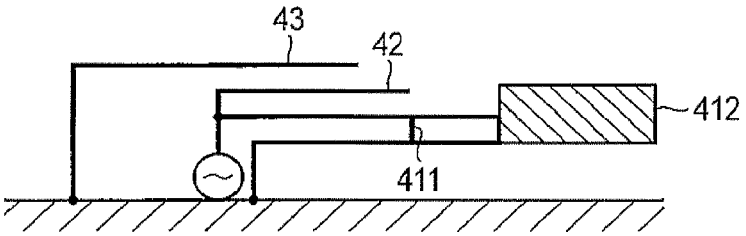

The antenna device shown in FIG. 34D is configured such that the portion between the middle portion and distal end portion of the section extending from the installation position of the stub 411 of the folded monopole element 41 with the stub to the folding end is formed from a wide plate-like element.

Figure 34E:
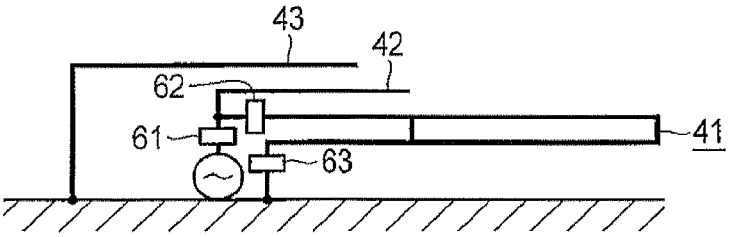

The antenna device shown in FIG. 34E is configured such that lumped parameter elements 61, 62 and 63 are respectively inserted in a portion near the feeding terminal 22 of the folded monopole element 41 with the stub and monopole element 42, the interval from the branch position between the folded monopole element 41 with the stub and the monopole element 42 to the installation position of the stub 411, and a portion near the first ground terminal 31 of the folded monopole element 41 with the stub. The lumped parameter elements 61, 62 and 63 are formed from inductances and have a function of increasing the electrical length of the folded monopole element 41 with the stub.

(2) Modification of Monopole Element 42

FIGS. 35A, 35B, 35C, 35D and 35E and FIGS. 36A, 36B, 36C and 36D show various modifications of the monopole element 42.

Figure 35A:
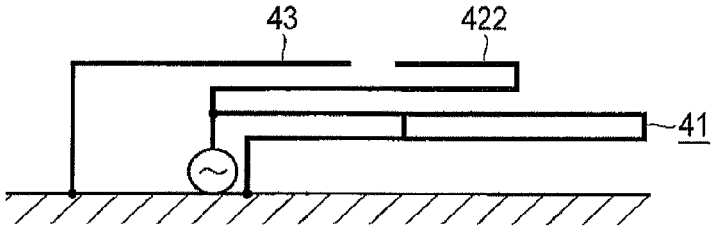
FIGS. 35A, 35B, 35C, 35D and 35E are views showing the first modification group of a monopole element.

The antenna device shown in FIG. 35A is configured such that the distal end portion of the monopole element 42 is folded. This makes it possible to reduce the installation space of the antenna device in the longitudinal direction of the monopole element 42 even if it has a long element length.

Figure 35B:
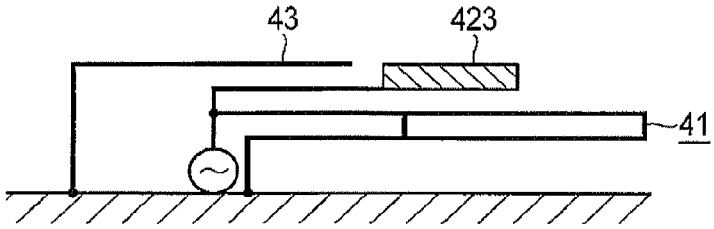

The antenna device shown in FIG. 35B is configured such that the monopole element 42 has a wide distal end portion.

Figure 35C:
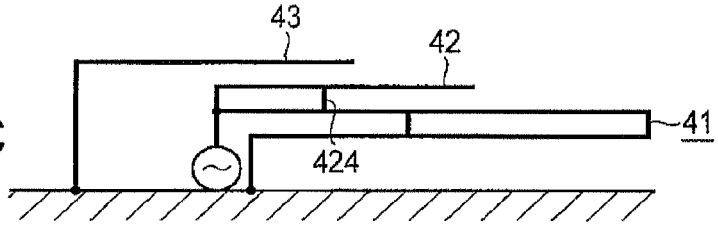

The antenna device shown in FIG. 35C is configured such that the monopole element 42 is connected to the folded monopole element 41 with the stub through the connecting element 424 at a position where they are parallel to each other.

Figure 35D:
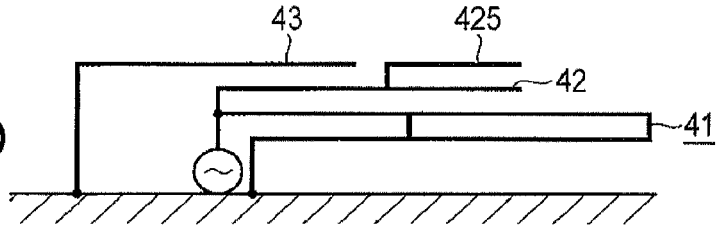

The antenna device shown in FIG. 35D is configured such that the distal end portion of the monopole element 42 is branched to provide an additional element 425. Note that the device shown in FIG. 35D is provided with only one additional element 425. However, two or more additional elements may be provided.

Figure 35E:
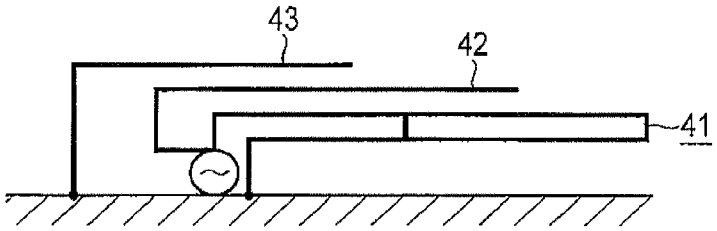

The antenna device shown in FIG. 35E is configured such that the monopole element 42 is branched at the feeding terminal 22 or at its nearby position without being branched midway along the folded monopole element 41 with the stub.

Figure 36A:
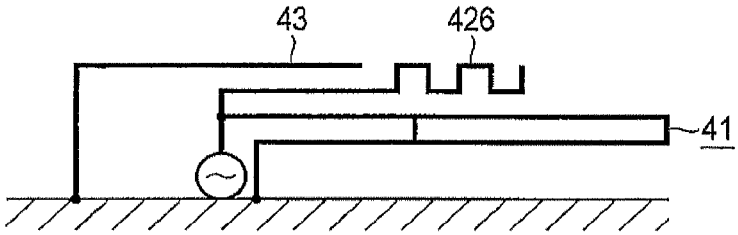
FIGS. 36A, 36B, 36C and 36D are views showing the second modification group of a monopole element.

The antenna device shown in FIG. 36A is configured such that the distal end portion of the monopole element 42 is formed into a meandering shape.

Figure 36B:
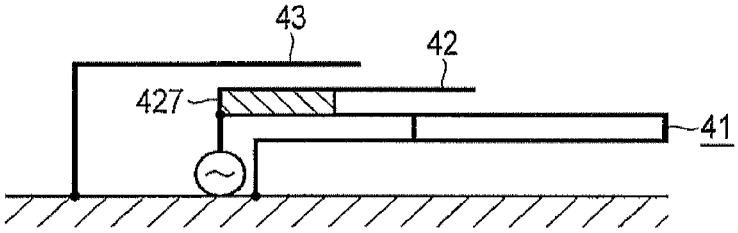

The antenna device shown in FIG. 36B is configured such that a connecting portion 427 of the monopole element 42 for the folded monopole element 41 with the stub is formed into a wide portion.

Figure 36C:
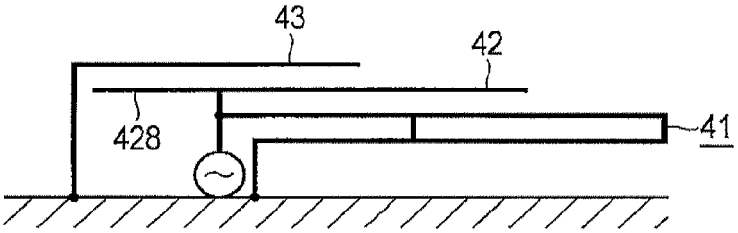

The antenna device shown in FIG. 36C is configured such that a second monopole element 428 is provided on the monopole element 42 in a direction opposite to the bending direction of the monopole element 42. Although FIG. 36C shows a case in which one second monopole element 428 is provided, two or more second monopole elements may be provided.

Figure 36D:
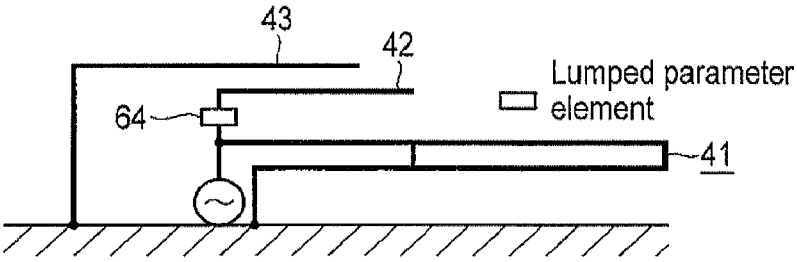

The antenna device shown in FIG. 36D is configured such that a lumped parameter element 64 is inserted in a portion near the connecting portion between the monopole element 42 and the folded monopole element 41 with the stub. The lumped parameter element 64 is formed from an inductance and has a function of increasing the electrical length of the monopole element 42.

(3) Modification of Parasitic Element 43

FIGS. 37A, 37B, 37C, 37D and 37E and FIGS. 38A, 38B, 38C and 38D show various modifications of the parasitic element 43.

Figure 37A:
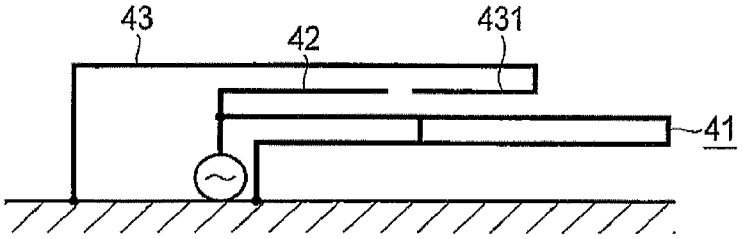
FIGS. 37A, 37B, 37C, 37D and 37E are views showing the first modification group of a parasitic element.

The antenna device shown in FIG. 37A is configured such that the distal end portion of the parasitic element 43 is folded.

Figure 37B:
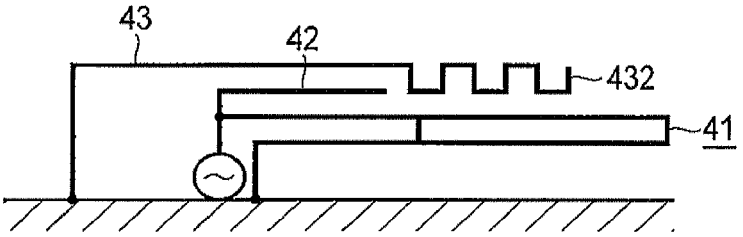

The antenna device shown in FIG. 37B is configured such that the distal end portion of the parasitic element 43 is formed into a meandering shape. This makes it possible to reduce the installation space of the antenna device in the longitudinal direction of the parasitic element 43 even if it has a long element length.

Figure 37C:
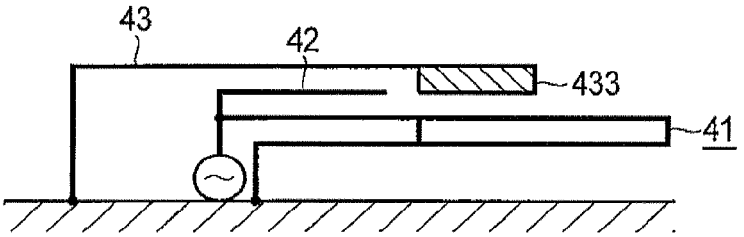

The antenna device shown in FIG. 37C is configured such that the parasitic element 43 has a wide distal end portion.

Figure 37D:
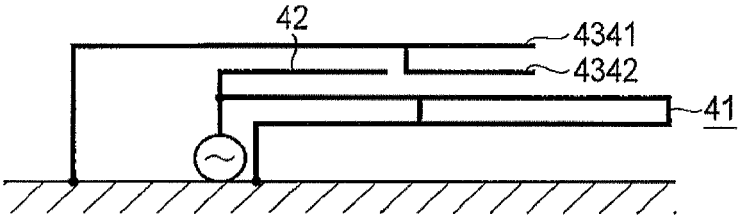

The antenna device shown in FIG. 37D is configured such that the distal end portion of the parasitic element 43 is branched into a plurality of portions to provide a plurality of elements 4341 and 4342. In the case shown in FIG. 37D, the distal end portion is branched into two portions. However, the distal end portion may be branched into three or more portions.

Figure 37E:
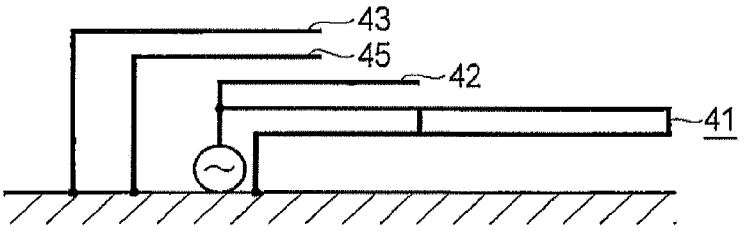

The antenna device shown in FIG. 37E is configured such that a plurality of parasitic elements 43 and 45 are provided between the feeding terminal 22 and the second ground terminal 32.

Figure 38A:
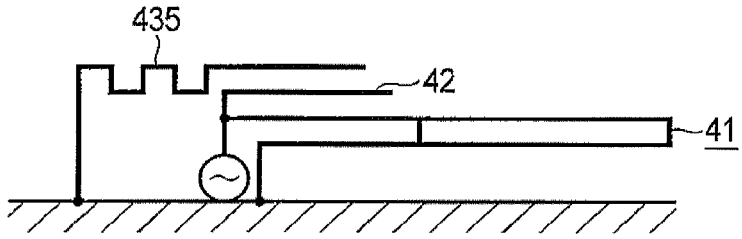
FIGS. 38A, 38B, 38C and 38D are views showing the second modification group of a parasitic element.

The antenna device shown in FIG. 38A is configured such that the middle portion of the parasitic element 43 is formed into a meandering shape. This arrangement makes it possible to reduce the installation space of the antenna device in the longitudinal direction of the parasitic element 43 even if it has a long element length.

Figure 38B:
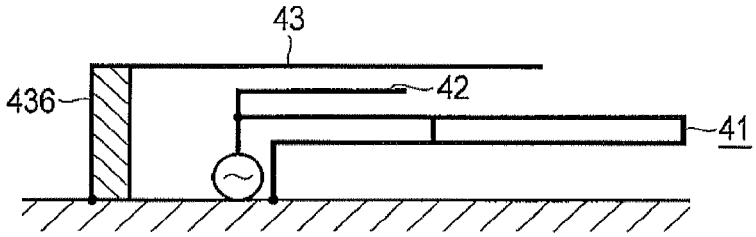

The antenna device shown in FIG. 38B is configured such that the proximal end portion of the parasitic element 43 which is near the second ground terminal 32 is formed into a wide portion.

Figure 38C:
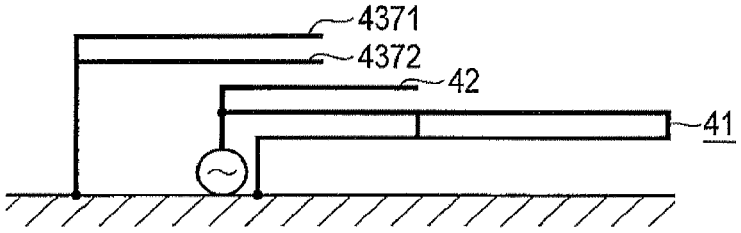

The antenna device shown in FIG. 38C is configured such that the parasitic element 43 is branched into a plurality of portions at a position where it is bent in an L shape, thereby providing a plurality of elements 4371 and 4372. In the case shown in FIG. 38C, the parasitic element 43 is branched into two portions. However, the parasitic element 43 may be branched into three or more portions.

Figure 38D:
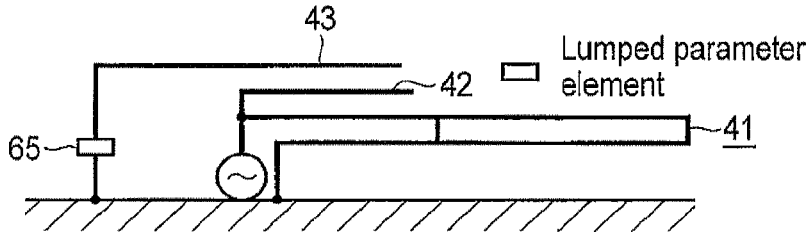

The antenna device shown in FIG. 38D is configured such that a lumped parameter element 65 is inserted in a portion near the connecting position between the parasitic element 43 and the second ground terminal 32. The lumped parameter element 65 is formed from an inductance and has a function of increasing the electrical length of the parasitic element 43.

(4) When Parasitic Element is Added

Figure 39A:
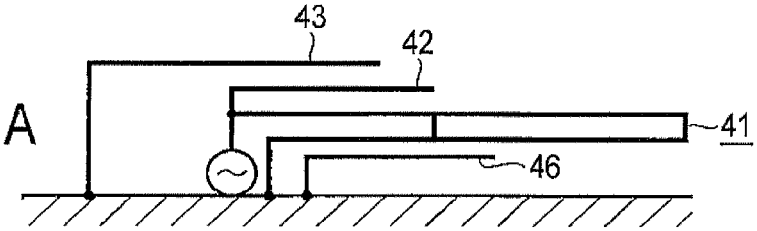
FIGS. 39A and 39B are views showing a modification group to which the second parasitic element is added.
Figure 39B:
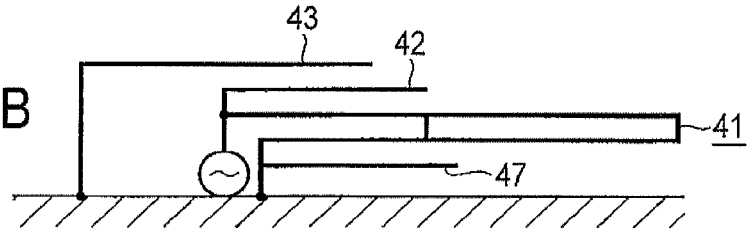

FIGS. 39A and 39B each show an example of the arrangement including an additional parasitic element.

FIG. 39A shows an arrangement in which a second parasitic element 46 is placed between the ground pattern 3 and the folded monopole element 41 with the stub independently of the folded monopole element 41 with the stub.

Referring to FIG. 39B, a second parasitic element 47 is placed between the ground pattern 3 and the folded monopole element 41 with the stub, and the ground terminal of the second parasitic element 47 is shared with the first ground terminal 31 of the folded monopole element 41 with the stub. The above arrangement can further increase the number of resonances and expand the band.

In addition, the shapes, installation positions, sizes of the folded monopole element with the stub, monopole element, and parasitic element and the types, arrangements, and the like of the electronic device can be variously modified and embodied.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

a first antenna element which is formed from a folded monopole element having one end connected to a feeding terminal, and the other end connected to a first ground terminal, with a stub being provided between a forward portion and a backward portion formed by folding a middle portion, and has an electrical length, extending from the feeding terminal to the first ground terminal through the other end of the folded portion, set to substantially one-half (½) of a wavelength corresponding to a predetermined first resonance frequency;

a second antenna element which is formed from a monopole element having one end connected to the feeding terminal directly or indirectly through part of the first antenna element, and the other end open, and has an electrical length, extending from the feeding terminal to the other end, set to substantially one-quarter (¼) of a wavelength corresponding to a predetermined second resonance frequency; and a third antenna element which is formed from a parasitic element having one end connected to a second ground terminal provided at a position opposite to the first ground terminal through the feeding terminal, and the other end open, with at least part of the parasitic element being placed parallel to the second antenna element so as to be configured to be capacitively coupled to the second antenna element, and has an electrical length, extending from the second ground terminal to the other end, set to substantially one-quarter (¼) of a wavelength corresponding to a predetermined third resonance frequency, wherein the other end of the parasitic element further extends from the other end of the monopole element of the second antenna element.

2. The antenna device of claim 1, wherein the other end of the parasitic element of the third antenna element extends from the other end of the monopole element of the second antenna element when the other end of the parasitic element of the third antenna element is physically separated from and collinear with the other end of the monopole element of the second antenna element.

3. The antenna device of claim 2, wherein the electrical length of the first antenna element is set to make the first resonance frequency lower than the second resonance frequency and the third resonance frequency.

4. The antenna device of claim 2, wherein the other end of the first antenna element is connected to the first ground terminal placed at a position at which a distance from the feeding terminal becomes not more than substantially ⅕ a wavelength corresponding to the first resonance frequency.

5. The antenna device of claim 2, wherein a section of the first antenna element which extends from an installation position of the stub to a folding end includes an element in a linear shape or a plate-like shape.

6. The antenna device of claim 2, wherein the first antenna element further includes at least one additional element having a distal end open in a section extending from an installation position of the stub to a folding end.

7. The antenna device of claim 2, further comprising:

a circuit board including a first area in which conductive patterns of the first antenna element, the second element, and the third antenna element and the feeding terminal are formed and a second area in which a ground pattern, with part of a side thereof being formed in a substantially crank shape, the first ground terminal, and the second ground terminal are formed; and a feeding cable which is placed on the second area such that a distal end portion of a conductive line protrudes from the side formed in the crank shape into the first area, and the protruding distal end portion of the conductive line is connected to the feeding terminal formed in the first area.

8. The antenna device of claim 2, further comprising a circuit board including a first area in which conductive patterns of the first antenna element, the second element, and the third antenna element and the feeding terminal are formed and a second area in which a ground pattern, with part of a side thereof being formed in a substantially crank shape, the first ground terminal, and the second ground terminal are formed; and an antenna base material made of a nonconductive material, wherein the circuit board includes a flexible substrate, and the first area of the flexible board is wound around the antenna base material.

9. The antenna device of claim 2, wherein at least the other end of the parasitic element is placed parallel to the second antenna element so as to be configured to be capacitively coupled to the second antenna element.

10. The antenna device of claim 2, wherein a distance between the second antenna element and the other end of the parasitic element which is placed parallel to the second antenna element is shorter than a distance between the feeding terminal and the second ground terminal.

11. An electronic device comprising:

a radio circuit configured to transmit and receive a radio signal; and an antenna device connected to the radio circuit through a feeding terminal and a ground terminal, the antenna device comprising a first antenna element which is formed from a folded monopole element having one end connected to a feeding terminal, and the other end connected to a first ground terminal, with a stub being provided between a forward portion and a backward portion formed by folding a middle portion, and has an electrical length, extending from the feeding terminal to the first ground terminal through the other end of the folded portion, set to substantially one-half (½) of a wavelength corresponding to a predetermined first resonance frequency, a second antenna element which is formed from a monopole element having one end connected to the feeding terminal directly or indirectly through part of the first antenna element, and the other end open, and has an electrical length, extending from the feeding terminal to the other end, set to substantially one-quarter (¼) of a wavelength corresponding to a predetermined second resonance frequency, and a third antenna element which is formed from a parasitic element having one end connected to a second ground terminal provided at a position opposite to the first ground terminal through the feeding terminal, and the other end open, with at least part of the parasitic element being placed parallel to the second antenna element so as to be configured to be capacitively coupled to the second antenna element, and has an electrical length, extending from the second ground terminal to the other end, set to substantially one-quarter (¼) of a wavelength corresponding to a predetermined third resonance frequency, wherein the other end of the parasitic element further extends from the other end of the monopole element of the second antenna element.

12. The electronic device of claim 11, wherein the other end of the parasitic element of the third antenna element extends from the other end of the monopole element of the second antenna element when the other end of the parasitic element of the third antenna element is physically separated from and collinear with the other end of the monopole element of the second antenna element.

13. The electronic device of claim 12, wherein the electrical length of the first antenna element is set to make the first resonance frequency lower than the second resonance frequency and the third resonance frequency.

14. The electronic device of claim 12, wherein the other end of the first antenna element is connected to the first ground terminal placed at a position at which a distance from the feeding terminal becomes not more than substantially ⅕ a wavelength corresponding to the first resonance frequency.

15. The electronic device of claim 12, wherein a section of the first antenna element which extends from an installation position of the stub to a folding end includes an element in a linear shape or a plate-like shape.

16. The electronic device of claim 12, wherein the first antenna element further includes at least one additional element having a distal end open in a section extending from an installation position of the stub to a folding end.

17. The electronic device of claim 12, further comprising:

a circuit board including a first area in which conductive patterns of the first antenna element, the second element, and the third antenna element and the feeding terminal are formed and a second area in which a ground pattern, with part of a side thereof being formed in a substantially crank shape, the first ground terminal, and the second ground terminal are formed; and a feeding cable which is placed on the second area such that a distal end portion of a conductive line protrudes from the side formed in the crank shape into the first area, and the protruding distal end portion of the conductive line is connected to the feeding terminal formed in the first area.

18. The electronic device of claim 12, further comprising a circuit board including a first area in which conductive patterns of the first antenna element, the second element, and the third antenna element and the feeding terminal are formed and a second area in which a ground pattern, with part of a side thereof being formed in a substantially crank shape, the first ground terminal, and the second ground terminal are formed; and an antenna base material made of a nonconductive material, wherein the circuit board includes a flexible substrate, and the first area of the flexible board is wound around the antenna base material.

19. The electronic device of claim 12, wherein at least the other end of the parasitic element is placed parallel to the second antenna element so as to be configured to be capacitively coupled to the second antenna element.

20. The electronic device of claim 12, wherein a distance between the second antenna element and the other end of the parasitic element which is placed parallel to the second antenna element is shorter than a distance between the feeding terminal and the second ground terminal.

21. An antenna device comprising:

a first antenna element that comprises a folded monopole element including (i) a first portion that comprises a first end coupled to a feeding terminal, (ii) a second portion that comprises a second end coupled to a first ground terminal and (iii) a third portion coupled to both the first portion and the second portion and comprises a stub provided between the first portion and the second portion;

a second antenna element that comprises a monopole element including a first end coupled to the feeding terminal directly or indirectly through part of the first portion of the folded monopole element and an open second end; and a third antenna element that comprises a parasitic element including (i) a first end coupled to a second ground terminal provided at a position so that the feeding terminal is positioned between the first ground terminal and the second ground terminal and (ii) an open second end with at least part of the parasitic element being positioned in parallel to and capactively coupled with the second antenna element, wherein the second end of the parasitic element is separated from and collinear with the second end of the monopole element of the second antenna element.

22. The antenna device of claim 21, wherein:

the first antenna element includes an electrical length, extending from the feeding terminal to the first ground terminal through the second end of the second portion, that is set to substantially a one-half of a wavelength corresponding to a first resonance frequency;

the second antenna element includes an electrical length, extending from the feeding terminal to the second end of the monopole element, that is set to substantially one-quarter of a wavelength corresponding to a second resonance frequency; and the third antenna element includes an electrical length, extending from the second ground terminal to the second end of the parasitic element, that is set to substantially one-quarter of a wavelength corresponding to a third resonance frequency.

* * * * *